US006897773B2

(12) United States Patent
Ridley

(10) Patent No.: US 6,897,773 B2
(45) Date of Patent: May 24, 2005

(54) COMPUTER POWERED WIRE(LESS) ULTRA-INTELLIGENT REAL-TIME MONITOR

(76) Inventor: Alfred Dennis Ridley, P.O. Box 12518, Tallahassee, FL (US) 32317-2518

( * ) Notice: Subject to any disclaimer, the term of this patent is extended or adjusted under 35 U.S.C. 154(b) by 345 days.

(21) Appl. No.: 10/307,748

(22) Filed: Dec. 2, 2002

(65) Prior Publication Data

US 2003/0164762 A1 Sep. 4, 2003

Related U.S. Application Data

(60) Provisional application No. 60/352,096, filed on Jan. 25, 2002.

(51) Int. Cl.[7] ..... G08B 29/00

(52) U.S. Cl. ..... 340/506; 340/539.1; 340/539.11

(58) Field of Search ..... 340/506, 539.1, 340/539.11, 539.22, 286.02

(56) References Cited

U.S. PATENT DOCUMENTS

| | | | | | |
|---|---|---|---|---|---|
| 3,707,679 | A | * | 12/1972 | Bruley et al. | 455/16 |
| 4,519,395 | A | | 5/1985 | Hrushesky | |
| 4,545,388 | A | | 10/1985 | John | |
| 4,547,778 | A | * | 10/1985 | Hinkle et al. | 342/456 |
| 4,583,524 | A | | 4/1986 | Hutchins | |
| 4,625,733 | A | | 12/1986 | Saynajakangas | |
| 4,844,086 | A | | 7/1989 | Duffy | |
| 5,185,700 | A | * | 2/1993 | Bezos et al. | 701/35 |
| 5,199,439 | A | | 4/1993 | Zimmerman et al. | |
| 5,215,098 | A | | 6/1993 | Steinhaus et al. | |
| 5,490,523 | A | | 2/1996 | Isaacson et al. | |
| 5,491,474 | A | | 2/1996 | Suni et al. | |
| 5,505,199 | A | | 4/1996 | Kim | |
| 5,549,113 | A | | 8/1996 | Halleck et al. | |
| 5,564,433 | A | | 10/1996 | Thornton | |
| 5,617,333 | A | * | 4/1997 | Oyamada et al. | 709/247 |
| 5,686,913 | A | * | 11/1997 | Coln et al. | 341/51 |
| 5,838,172 | A | * | 11/1998 | Ito | 327/20 |
| 5,941,820 | A | | 8/1999 | Zimmerman | |
| 6,011,477 | A | | 1/2000 | Teodorescu et al. | |
| 6,047,201 | A | | 4/2000 | Jackson | |
| 6,556,810 | B2 | * | 4/2003 | Suzuki | 455/88 |
| 6,678,532 | B1 | * | 1/2004 | Mizoguchi | 455/550.1 |

* cited by examiner

*Primary Examiner*—Daryl C. Pope

(57) ABSTRACT

A device (1)(2) and method to monitor, in real time, one or more variables by an at least 2500 hour water proof sensor/transmitter, not requiring recharge, placed at the source where data are automatically collected and transmitted by wire or wireless means (2A)(2B) to a battery-free computer-powered (2C) receiver connected to a computer, where software continuously analyzes and charts the data. The software auto and cross correlates the variables, continuously updates and displays the data on simple aggregate charts (4A) or decomposes the data and displays them on newly created common cause charts (4B)(4C) of internal systematically related effects and newly created special cause charts (4D)(4E) of external random unrelated effects, including summary data, and creates graduated progressive sound, color, print and world wide, fax, email and telephone alarm signals when the chart values exceed user specified limits, either in terms of actual units (4B)(4D) or standard deviations (4C)(4E), or when any particular pattern occurs. The device helps determine ahead of time, when the source of the monitored variables is functioning abnormally. Advance warning thus obtained, is used to initiate corrective action (3A)(3B)(3C)(3D) so as to prevent failure at the source that is generating the variables. Examples of failure that it helps prevent include but are not limited to, sudden infant death due to sudden infant death syndrome in human babies, heart or respiratory failure in any human being who is either at rest or moving around within a specified area, failure in industrial machines or measuring equipment, manufacturing defects and financial irregularities.

20 Claims, 12 Drawing Sheets

Figure 1:
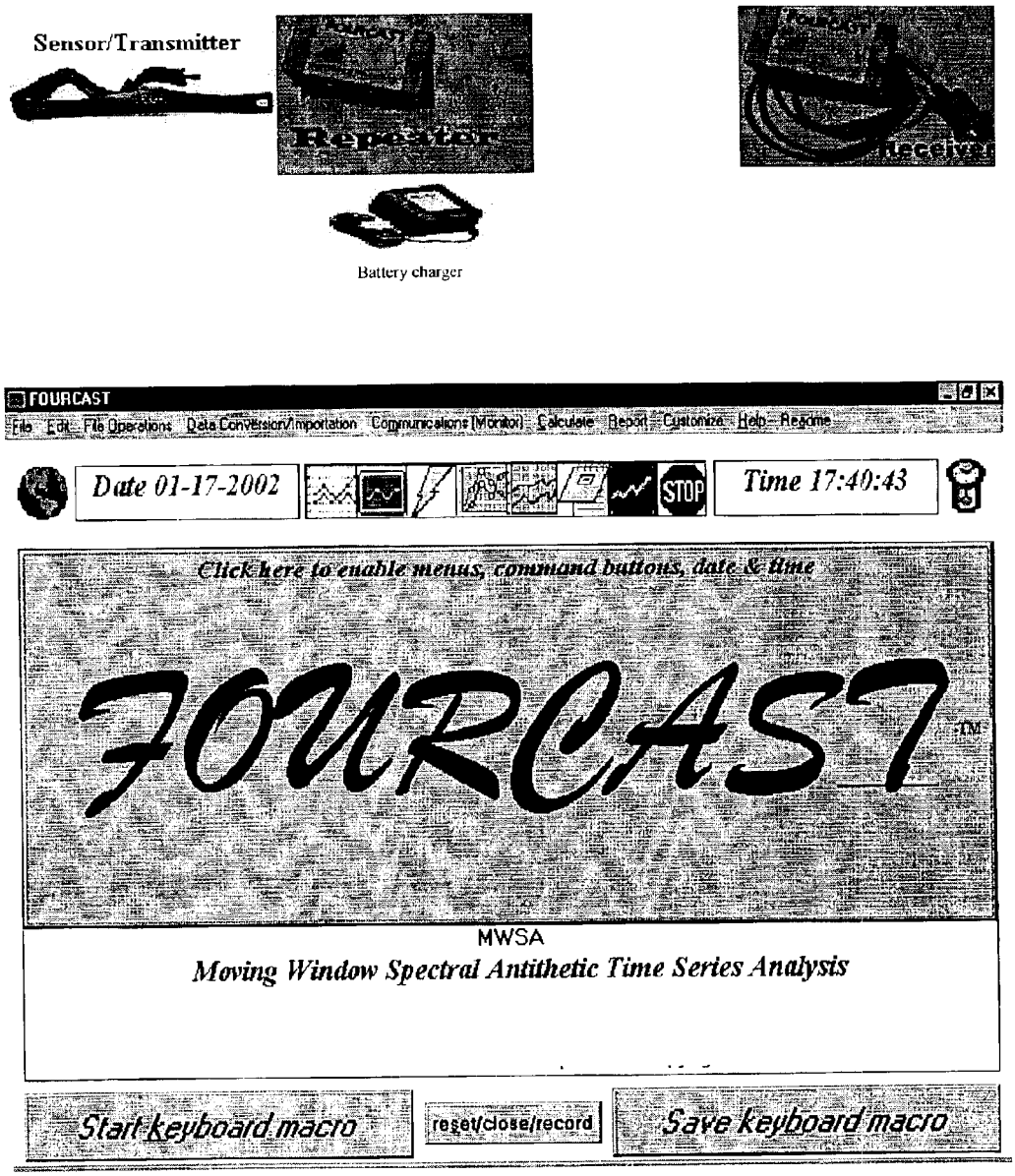

A: Short range (3ft) computer powered wire(less) ultra intelligent real-time monitor
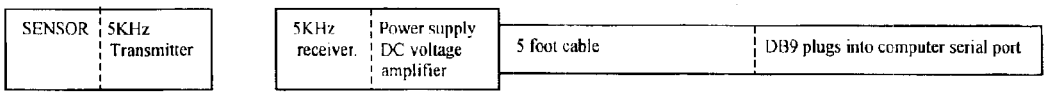
B: Long range (1000ft) computer powered wire(less) ultra intelligent real-time monitor
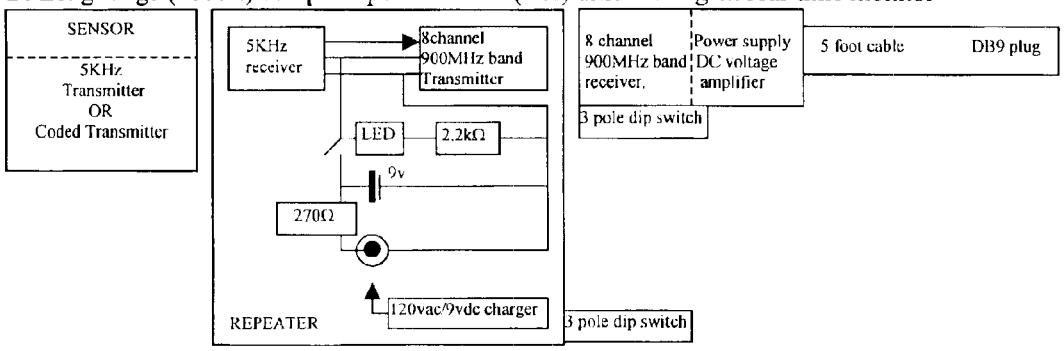
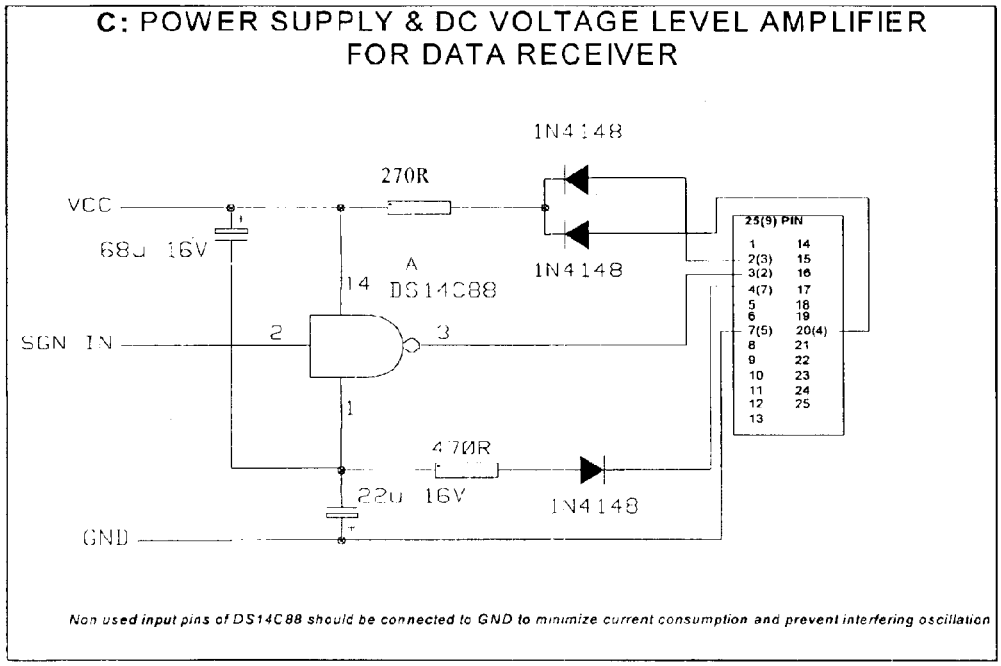
FIG 2.

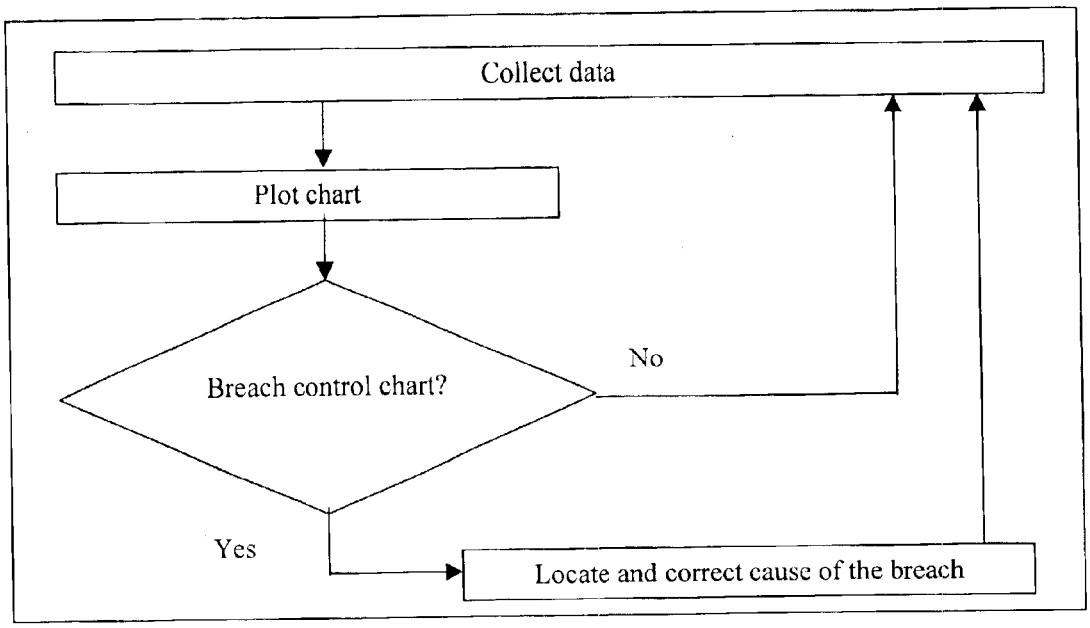
FIG. 3-A.

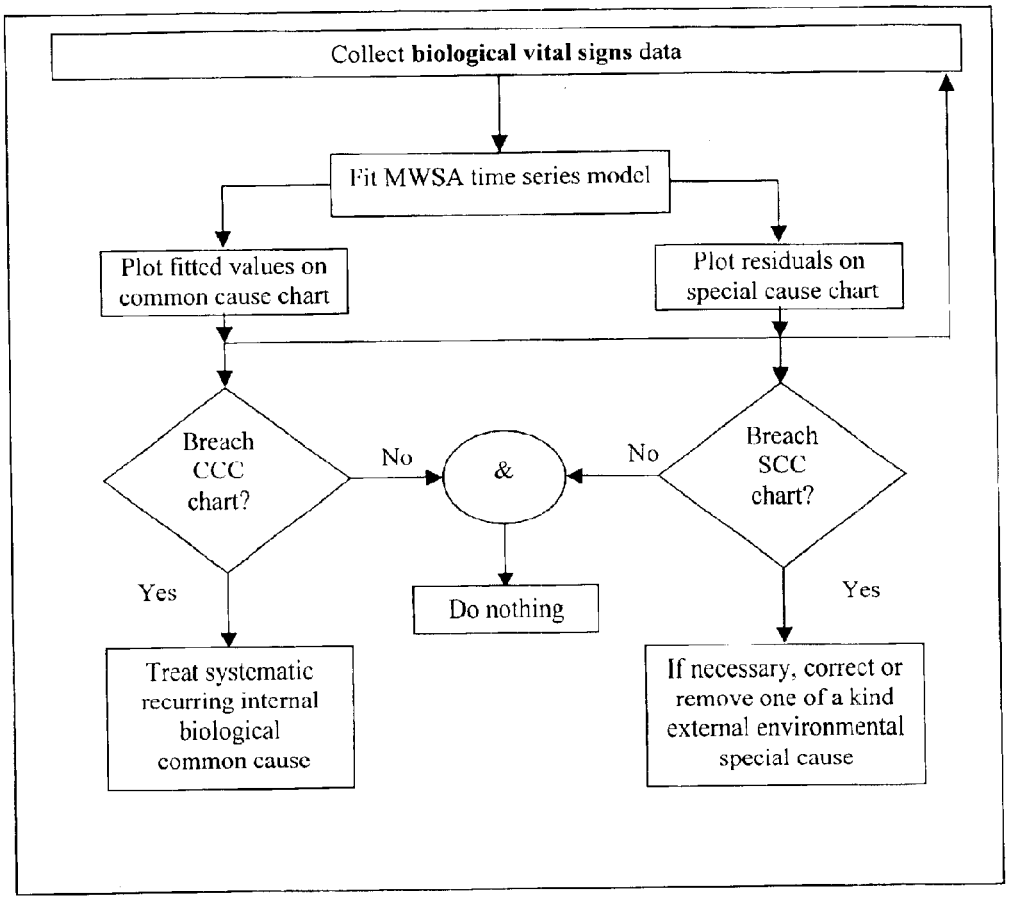
FIG. 3-B.

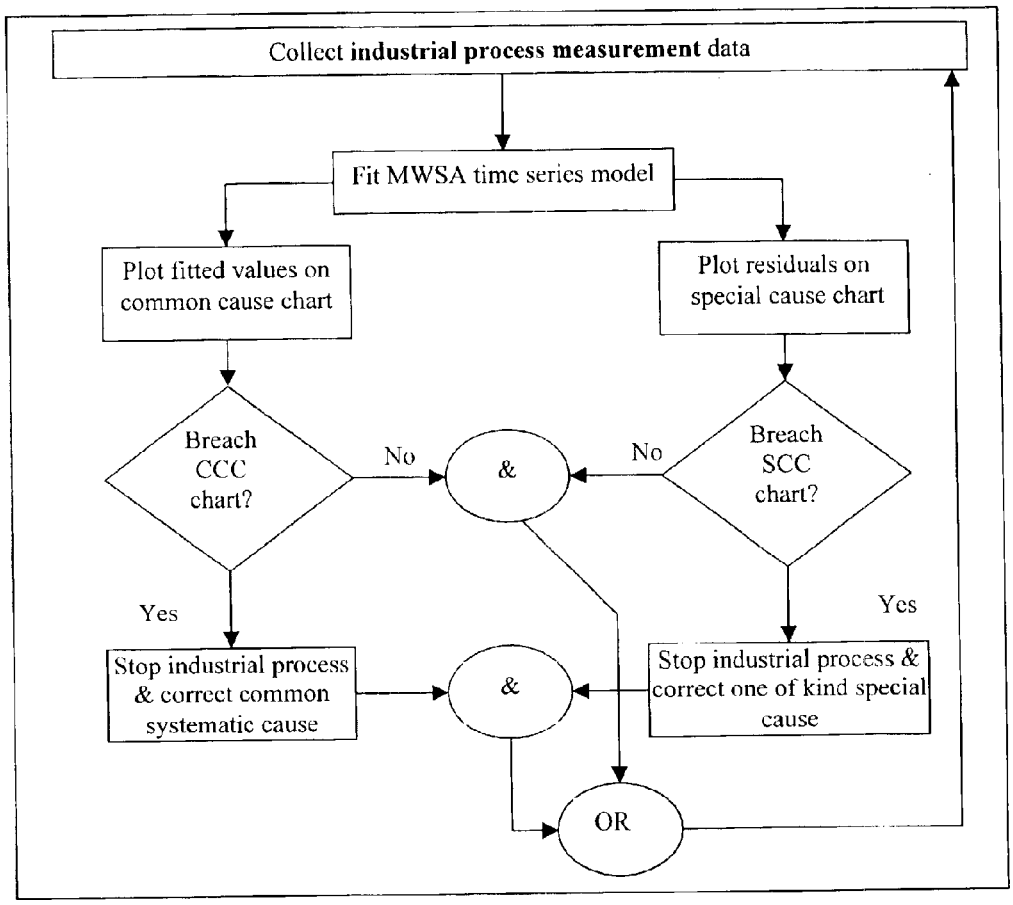
FIG. 3-C.

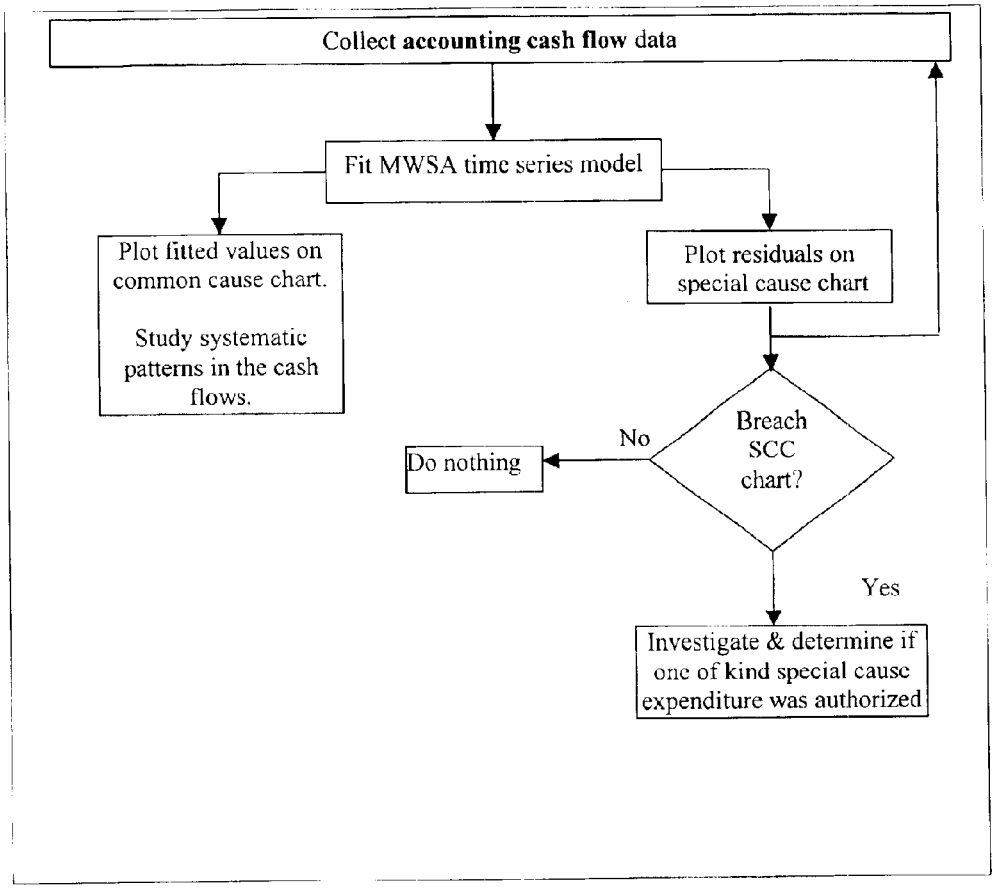
FIG. 3-D.

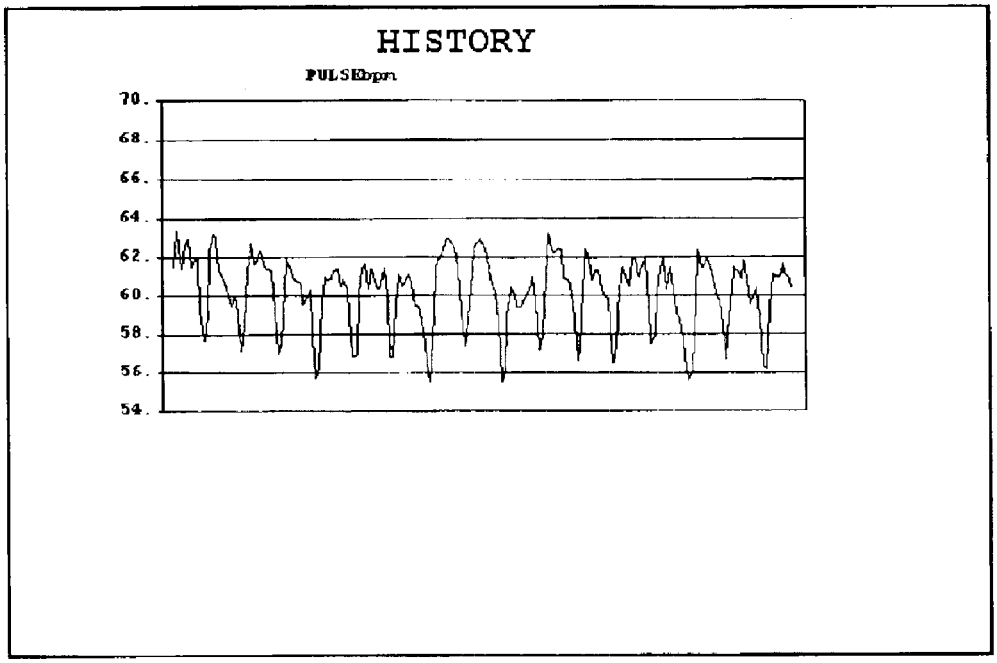
FIG. 4-A.

Print Edit Customize Transformations
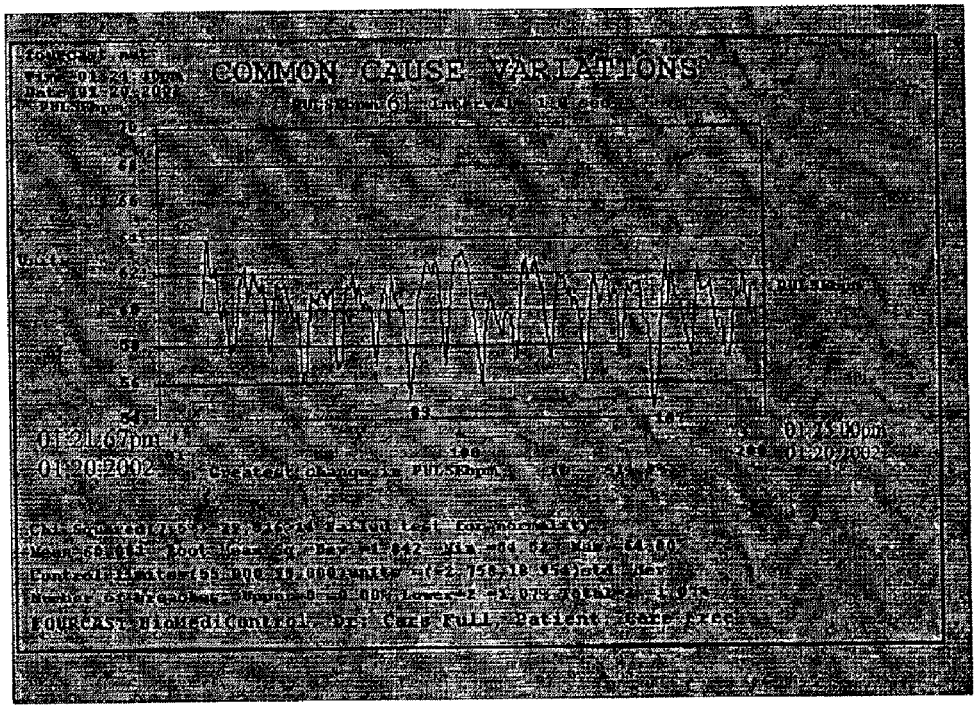
FIG. 4-B.

Print Edit Customize Transformations
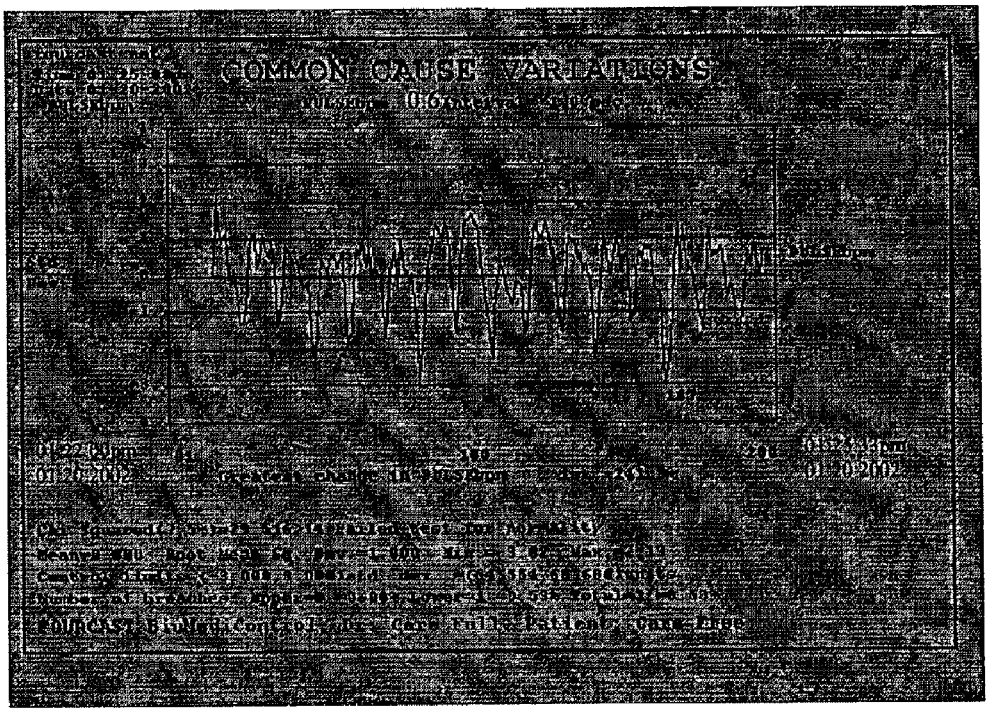
FIG. 4-C.

Print Edit Customize Transformations
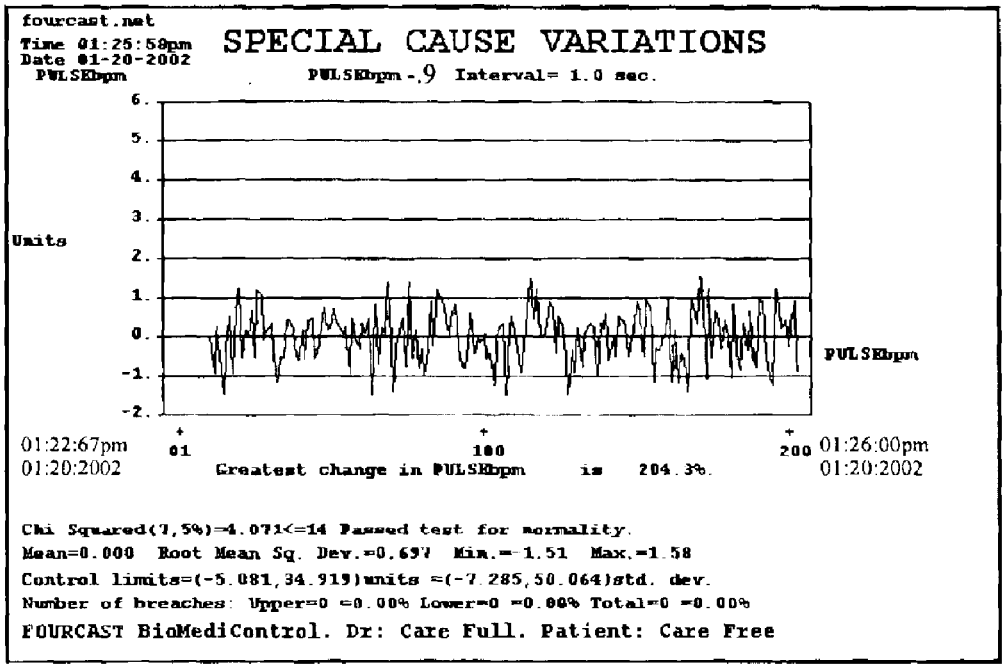
FIG. 4-D.

Print Edit Customize Transformations
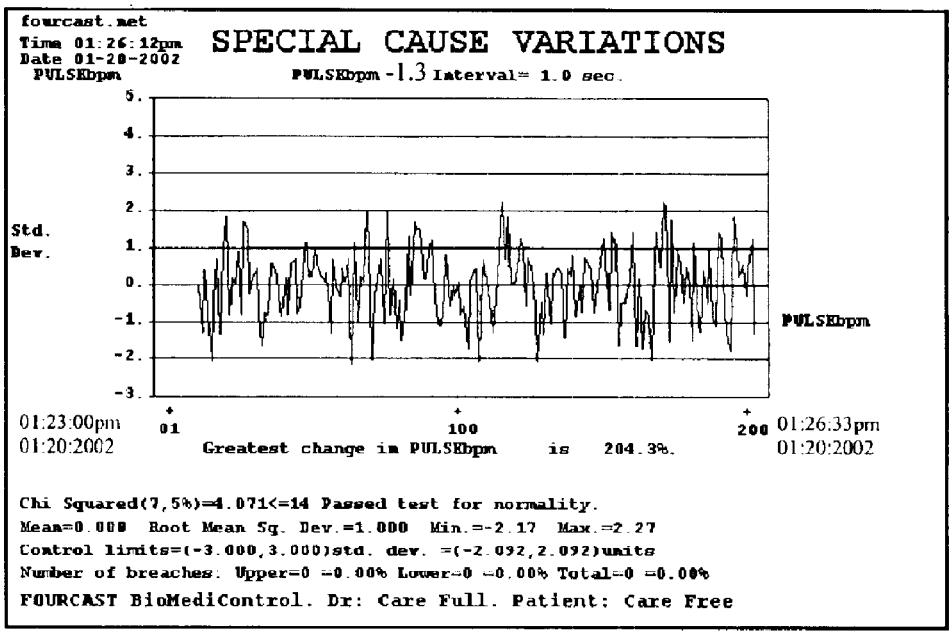
FIG. 4-E.

COMPUTER POWERED WIRE(LESS) ULTRA-INTELLIGENT REAL-TIME MONITOR

CROSS-REFERENCE TO RELATED APPLICATIONS

This application is entitled to the benefit of Provisional Patent Application Ser. No. 60/352,096 filed Jan. 25, 2002.

BACKGROUND

1. Field of Invention

This invention relates to universal electronic data monitoring including their collection, wire or wireless transmission, computer analysis, detection and the classification of abnormalities in the data, where such abnormalities result in automatic alarms that are transmitted to recipients locally or world wide, thereby providing a basis for taking corrective action at the source of the data.

2. Discussion of Prior Art

Methods Using Hard Wired Transmission:

The prior art U.S. Pat. No. 4,583,524 to Hutchins (1986) shows a instructional system for reviving the victim of a heart attach. U.S. Pat. No. 5,199,439 to Zimmerman et al. (1993) shows the use of a quality control chart for direct and simple monitoring of data. However, the chart is used in a way that is not statistically valid. The reason is as follows. Statistical quality control charts assume that the data on which they are based are independent. That is, each measurement is completely unrelated to all previous measurements. In reality, the measurements are serially related. This is known as autocorrelation. None of these patents employs correlation as part of its analysis. Since correlation analysis is at least one of the requirements to make the charts valid, no valid conclusions can be drawn from the charts that use these patents.

U.S. Pat. No. 4,545,388 to John (1985), U.S. Pat. No. 4,519,395 to Hrushesky (1985), U.S. Pat. No. 4,844,086 to Duffy (1989), U.S. Pat. No. 5,215,098 to Steinhaus et al. (1993), and U.S. Pat. No. 5,564,433 to Thornton (1996) employ relatively static measures of correlation, but do not apply them to the dynamic creation of a valid quality control chart.

U.S. Pat. No. 5,941,820 to Zimmerman (1999), employs correlation. However, correlation is limited to autocorrelation in a single variable. It does not employ cross correlation analysis to incorporate the effects of other related variables. Also, it does not split the data into separate correlated and uncorrelated components of the data. Instead, autocorrelation is used to modify control chart limits, such that different control limits exist on a single chart. This is done in an attempt to create control limits which are more appropriate. Varying limits, all existing on the same chart, make the chart far more complicated, very difficult to read and very confusing. This patent shows software that to function, requires an expensive and dedicated medical prescription sensor/monitor, currently used in hospitals.

U.S. Pat. No. 5,505,199 to Kim requires a combination of pulse oximeter, motion detector, and video camera connected to a central unit, making it cost prohibitive for most home users. U.S. Pat. No. 5,490,523 to Isaacson et al. (1996) uses a pulse oximeter with built in readout but no alarm feature. U.S. Pat. No. 6,011,477 to Teodorescu, et al. (2000) does not affix any biomedical sensors to the human body and does not measure any actual internal biomedical vital signs. Any external motion detector is likely to alarm when it is too late to take corrective action.

None of these patents employs wireless transmission of data. Data sensors must be physically attached to a human being and hard wired to some other device. This limits the mobility of the person being monitored. Movement can cause wires to come loose. Wires can also be hazardous, especially to babies.

Methods Using Wireless Transmission:

U.S. Pat. No. 6,047,201 to Jackson (2000), uses a battery operated sensor (pulse oximeter) to collect data from a human baby, and transmits the data via the 900 MHz band to a battery operated monitor. The radio frequency operation prohibits its use in hospitals. Transmission in the 900 MHz band is very demanding on the battery. The sensor must be removed from the baby, periodically, to recharge the battery. Because of the charger port, the sensor cannot be sealed for water proofing. The monitor must also be recharged. Therefore, continuous monitoring is not possible for any appreciable length of time. The patent shows 8 hours. A baby can fall asleep anytime without notice. If the baby falls asleep while the sensor is being charged, there will be no data collection and therefore no monitoring. In any case the patent is limited to babies that are asleep. However, a baby can experience respiratory and/or cardiac difficulties while awake. The patent shows a 900 MHz band transmitting antenna as a wire with no constructed ground plane. In the 900 MHz frequency band, a wire antenna, or any other antenna without a ground plane, de-tunes when it is in proximity to the human body which also acts as an antenna. The receiving antenna is subject to the same defect. De-tuning means that the transmission frequency varies. Therefore, the signal is either altered so that the monitor receives incorrect and dangerously misleading values, or it becomes lost altogether between the transmitter and the receiver in the monitor. The user cannot change the transmission frequency to avoid interference from other devices transmitting at the same frequency. The monitor is limited to oxygen data, and shows only one oxygen measurement at a time. If the measurement drops below a predetermined level it sounds an alarm. There is no alarm for the case when a biomedical vital sign goes above a predetermined level. This patent is limited to monitoring a single vital sign in actual units. There is no alarm for the case when there is a sudden change in the vital sign. This patent does not employ autocorrelation or cross correlation and does not use a quality control chart. Therefore, there is no way to get a picture, pattern or any other sense of how the data is developing over time. U.S. Pat. No. 5,549,113 to Halleck, et al. (1996) shares similar features and shortcomings. It promises a transmission range of only 90 feet, which after accounting for adverse prevailing conditions (interference, metal sidings and walls containing electrical wires, etc.), is limited to just the room where the sensor is located. Continuous transmission at the frequency shown is not permitted by the FCC. Transmission is only intermittent. Therefore, there is no continuous monitoring.

Additional Shortcomings of the Prior Art.

In addition to the shortcomings listed above for each of the two sets of monitors, the following are shortcomings common to both. They all require expensive prescription sensor/monitors. None of them does multivariate data analysis designed to collectively support diagnosis, decision making and corrective action. None of them cross correlates two or more related variables. Therefore, only one variable at a time is monitored. None of them decomposes the data and displays them on common cause charts of internal systematically related effects and special cause charts of external random unrelated effects. None of them provides long duration independent sensors that can be connected to a monitor either by wire or wireless means. Either the battery has to be replaced or the sensor has to be removed and recharged during the time when it is required to be in operation. None of them provides universal ability to read data formats from different sources containing various combinations of variables. They all provide a limited alarm function. None of them provides graduated progressive sound, color, print and world wide, fax, email and telephone alarm signals when the chart values exceed predetermined or user specified limits, either in terms of actual units or standard deviations, or when any particular pattern occurs.

The patents closest to the present invention are U.S. Pat. No. 5,941,820 to Zimmerman et al. (1999) and U.S. Pat. No. 6,047,201 to Jackson (2000). U.S. Pat. No. 5,941,820 to Zimmerman et al. (1999) shows charting, albeit a single chart only. However, it shows no wireless means or graduated alarms. U.S. Pat. No. 6,047,201 to Jackson (2000) shows wireless means of transmission, albeit of short duration only. However, it shows no charts and no graduated alarms. The present invention shows hard wired and wireless means of transmission, multiple variables—each with dual charts, and a system of graduated multiple alarm types.

SUMMARY

In accordance with the present invention, a computer powered wire(less) ultra-intelligent real-time monitor exists in two arrangements, a short range monitor and a long range monitor. The short range monitor is comprised of a sensor/transmitter (if wireless), a receiver and computer software. The long range monitor is comprised of a sensor/transmitter (if wireless), a repeater (if wireless), a receiver and computer software. A suitable sensor/transmitter is of the type described in U.S. Pat. No. 4,625,733 to Saynajakangas (1986) and U.S. Pat. No. 5,491,474 to Suni, et al. (1996). The software operates on a computer to accept, time and date stamp, analyze and transform data, to display charts, upper and lower control limits, and summary data, and to initiate a sequence of graduated progressive sound and color alarms that are audible and visible from a distance. It also initiates print, and local or world wide fax, email, and pager/beep or telephone alarms. The alarms provide notification of the onset of abnormalities in the data being monitored so that corrective action can be taken at the source. The synergistic combination of these component parts greatly exceeds the sum of what each of them can accomplish separately.

Several of the examples given below use biological vital signs data for the purpose of illustration. These are not in any way intended to imply a limitation of the scope and universal applicability of the monitor. The principles developed apply similarly to other data.

Objects And Advantages

Accordingly, several objects and advantages of my invention are:

a) To provide a method for long term continuous uninterrupted wireless transmission of the data to a computer which acts as the monitoring device. The very low frequency (5 KHz band) and low power transmitter and receiver in the short range monitor (for example the baby monitoring application) operate for at least 2500 hours on a single miniature battery.

b) To provide a comfortable ultra light weight sensor/transmitter, free of large batteries, and radio frequency transmitters, suitable for wearing by a baby or an adult.

c) To provide an inexpensive, easy to use, fully automatic, full featured, over the counter, vital signs monitor for home use.

d) To provide a short range monitor for hospital use (due to very low frequency {5 kHz band} and short range {approximately 3 feet}, interference with other hospital equipment is easily avoided).

e) To provide a water proof sensor/transmitter that can be used in a wet environment. A wet environment can arise from bed wetting/incontinence. When the long range monitor is to be operated in a wet environment, the repeater is simply placed in a sealed water proof box.

f) To eliminate batteries in the receiver. The absence of batteries is a highly desirable feature and is very important in applications such as a heart monitor where reliability is important.

g) To prevent de-tuning of the sensor/transmitter. At low frequency (5 KHz band), very low power and short range, the transmitter uses no external antenna and never de-tunes, even when affixed to the human body.

h) To provide a very long transmission range, limited only by the FCC government regulation of 1,000 feet. A 900 MHz band repeater, not affixed to the human body, is used to extend the range of operation by means of external transmitter and receiver whip antennae. Using different frequencies, 5 KHz for the input and 900 MHz for the output prevents signal cancellation and any other potential conflict.

i) To prevent de-tuning during long range transmission. The transmitter and receiver in the long range monitor use a carefully constructed ground plane to prevent de-tuning. If the repeater is to be placed in contact with the body, the external transmitter whip antenna is replaced by a special internal loop transmitter antenna to prevent de-tuning.

j) To permit the user to change the 900 MHz band transmission frequency channel to avoid interference from other devices that would otherwise be transmitting at the same frequency as the repeater.

k) To provide a uniquely coded data transmission for security and integrity.

l) To provide software filtering of extraneous transmissions received at the computer.

m) To provide universal ability to read data formats containing various combinations of variables, from different sources including a serial, USB or other port, a keyboard, a data file created by another application, data copied from the computer screen, or data downloaded from another computer or from the internet.

n) To provide continuous data collection, time and date stamping, transformation according to desired mathematical formula and storage, including retrievable backup data from a prior monitoring session.

o) To provide a continuous display of various user specified time spans of data (example: last 5 minutes, last 8 hours, etc.) by automatically grouping the data, accordingly.

p) To continuously display summary data (example: mean, standard deviation, number of breaches of the upper and lower control limits, etc.).

q) To provide a monitor not only for babies but human beings of all ages, designed so that it can be customized according to age group.

r) To provide a monitor whose sensor/transmitter operates continuously, free of need to be recharged, while the person being monitored is awake or asleep.

s) To provide a monitor that is automatically calibrating, and whose user may set age and sex specific, or other upper and lower control limits. The alarm is initiated when the custom chart limits are exceeded or when sudden changes occur in the data. Sudden changes are measured relative to recent past data values. Therefore, the monitor also automatically customizes itself to the individual human being, regardless of age or sex. Abnormality is judged relative to 1) known medical standards for the relevant human sub population (age and sex), or user specified standards, 2) the recent past data for the individual being monitored.

t) To provide dual quality control charts, correcting for the effects of autocorrelation in each variable being monitored, and cross correlation with other variables. At least three embodiments of this feature for applications in biomedical, manufacturing and auditing applications are as follows:

Biomedical

The meaning and the importance of the new dual chart system is summarized as follows by considering its application to biological vital signs data such as heart rate and oxygen saturation. The principle of the dual chart system applies similarly to other data. Unlike a simple machine, the human body has natural internal self-correcting mechanisms. Biological data collected serially over time are therefore related to each other. That is, they are systematic and correlated. They are not independent data. They cannot be represented and analyzed by the existing method of standard control charts because such charts are valid only for independent data. Even a simple visual analysis is misleading. Biological data also contain a component that is not correlated. That is, a random and independent component. When the data are represented by the existing method of a single chart, the systematic and random effects are confounded, preventing proper and/or accurate diagnosis of the human biological condition.

The invention splits the data into systematic (correlated) and random (independent) components. It creates and uses the common cause effects chart to represent the part of the data that is systematically related, and the special cause effects chart to represent the part of the data that is randomly independent. The common cause chart identifies what is systematically occurring, internally, inside the body, due either to normal health, healing or failing health. The special cause chart identifies what is occurring in the external environment, and impacting on the body. For example the effects of a one of a kind loud noise that is startling, raises heart rate temporarily but does not repeat in a systematic way. Dual charts permit and facilitate proper analysis and diagnosis of the human biological condition as far as can be determined from the data. The dual chart system also reduces the number of false alarms or false positives that distract the attention of valuable personnel away from real and important problems, and reduces the number of false negatives when real and important problems go unnoticed. These features are greatly needed.

This new method of splitting the data and the notion of the presence of the elements of the new dual chart system are both initially counter intuitive, and are therefore unobvious to any person who has ordinary skill in the specific technologies involved in the invention.

Manufacturing

Consider next, the application to an industrial process. The common cause effects chart for this type of data may be a recurring cyclical pattern caused by, for example, a worn machine bearing, internal to the process. By examining the common cause effects chart, the pattern can be associated with its probable cause and the defective bearing identified and located. All parts must wear, and must wear out eventually. The defective bearing can be changed during the next scheduled plant maintenance shut down. Otherwise, the bearing wear may reduce product quality. It will eventually fail, forcing an unscheduled shut down, a new bearing anyway, and all attendant costs of a forced shut down. The special cause effects chart for this type of data may reveal for example, a random one-time raw material departure from what is required. This is, an external effect due to a bad batch of raw material. In that case, the supplier must be contacted to rectify the problem.

Auditing

Consider next, the application to financial auditing. The common cause effects chart for this type of data will reflect seasonal and other systematic expenditure patterns that are considered normal. The special cause effects chart will indicate unusual expenditures that might otherwise go unnoticed, due their interaction with the systematic effects. They may simply be obscured if the systematic effects are large. The unusual expenditures are marked for further investigation to determine whether they were authorized or unauthorized. Even if the unusual expenditures would have eventually been found by a manual search, the special cause effects chart saves valuable time and effort.

u) To create separate disk files of common cause variations and the special cause variations data that can be read by other computer programs and used to manipulate and control other devices and processes. Such other computer programs may be activated independently or activated by the program embodied in this invention.

v) To provide statistically unbiased quality control charts.

w) To initiate sound and color alarms when a value on either the aggregate history chart, the common cause chart, or the special cause chart exceeds the upper control limit or the lower control limit, in 1) actual units 2) standard deviations.

x) To mark and display current and historical breaches of the upper and lower chart limits for use as an additional diagnostic tool.

y) To initiate a graduated progressive and therefore false alarm free sound, color, print and world wide email, fax, and telephone alarm sequence if any chart values persistently breach either the upper or lower limit of any chart. The user sets the time delay until when the breaches are considered to be persistent.

z) To initiate a graduated progressive and therefore false alarm free sound, color, print and world wide email, fax, and telephone alarm sequence if the sensor/transmitter is removed, if there is a loss of power anywhere in the system, or if there is a disconnect or a break in data transmission for any reason.

aa) To copy and paste the charts into another computer program, such as a word processor, so as to prepare a more extensive report that incorporates information from the chart.

These innovations are unobvious to any person who has ordinary skill in the specific technologies involved in the invention.

Other Objects And Advantages

Consider an industrial application wherein as an after thought, a new variable is to be monitored, but where no wiring currently exists, or where installing wires is not immediately technically feasible. It may be possible to easily retrofit the monitor to such an infrastructure. The sensor/transmitter can be installed to collect and transmit data to the repeater which is conveniently located at a feasible location within about 3 feet of the sensor/transmitter. The repeater then transmits data to a control room where the computer is located.

Consider a heart attack victim for which the emergency telephone alarm is initiated. By printing up to date charts as part of the alarm sequence, an emergency medical team that is responding to the computer activated telephone call can simply and immediately pick up, examine, and transport the printed charts and the victim to a hospital. Such charts would not otherwise be immediately available.

In a noisy environment, the sound alarm could go unnoticed. However, it is very difficult not to notice a combination of full screen color, print, fax, email and pager/beeper or telephone alarms, especially when the telephone and fax machine are elsewhere in a quiet location. Also, the system is false alarm free since the graduated method allows the responder to gauge the severity of the abnormality in the data that has caused the alarm, and to respond accordingly.

The long range monitor allows the user to travel within an area of over three million square feet (over seventy acres). A home user, even allowing for adverse prevailing conditions (interference, metal sidings and walls containing electrical wires, etc.), can move in and around a very large house and property to perform activities such as gardening, croquet, putting out the trash and retrieving the mail.

The long range monitor functions as an electronic travel limit detector, since it will alarm when the wearer of the sensor/transmitter moves outside the range of the transmitter. A person suffering from presenile dementia or other mental degeneration such as alzheimer's disease can benefit from this feature. The range may be shortened by attenuating (reducing) the transmitter antenna power. For example, if the wearer is a baby, then the area in which the baby can travel before the alarm is initiated, can be reduced.

This invention uses a computer to execute the related software, to display the charts and data, and to activate the alarms. This reduces the cost to the user who may utilize any existing computer that they already own. The user can continue to use their computer simultaneously, while the monitor is in operation.

Still further objects and advantages will become apparent from consideration of the drawings and ensuing description.

DRAWINGS

FIG. 1. Picture of sample working prototype sensor/transmitter, repeater, receiver & computer program menus.

FIG. 2. Short range (3 ft) computer powered wire(less) ultra intelligent real-time monitor—A.

Long range (1000 ft) computer powered wire(less) ultra intelligent real-time monitor—B.

Power supply & dc voltage level amplifier for data receiver—C.

FIG. 3-A. Old method of single chart statistical process control.

FIG. 3-B. New method of splitting biological vital signs data into dual common cause chart (CCC) of systematic effects and special cause chart (SCC) of random one of kind effects, by the Moving Window Spectral Antithetic time series model, and attending to the causes of any chart breaches.

FIG. 3-C. New method of splitting industrial process data into dual common cause chart (CCC) of systematic effects and special cause chart (SCC) of random one of kind effects, by the Moving Window Spectral Antithetic time series model, and attending to the causes of any chart breaches.

FIG. 3-D. New method of splitting accounting cash flow data into dual common cause chart (CCC) of systematic effects and special cause chart (SCC) of random one of kind effects, by the Moving Window Spectral Antithetic time series model, and attending to the causes of any chart breaches.

FIG. 4-A. Simple aggregate history chart in original units.

FIG. 4-B. Sample common cause variations chart in original units.

FIG. 4-C. Sample common cause variations chart in standard deviations.

FIG. 4-D. Sample special cause variations chart in original units.

FIG. 4-E. Sample special cause variations chart in standard deviations.

Figure 5:
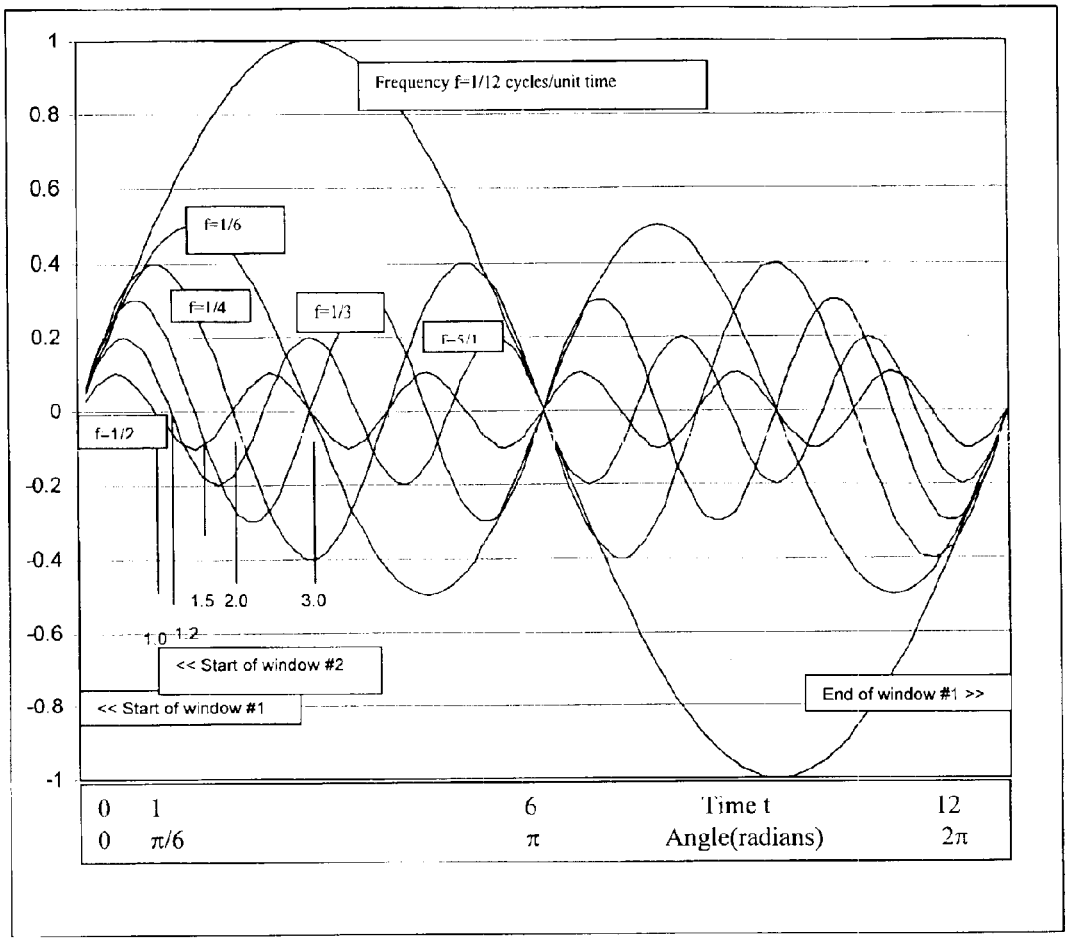

FIG. 5. Hypothetical family of cycles for window #1 in the moving window spectral antithetic time series model.

List of Parts

The list of parts shown below are given as examples only, to match the sample working prototype shown in FIG. 1 & FIG. 2. Because part numbers are necessary for their identification, a particular supplier may be implied, incidentally. However, based on their functional description, each part may be replaced by its equivalent from any other supplier, without changing the invention.

- Short range (3 ft) computer powered wire(less) ultra intelligent real-time monitor
  - FOURCAST.ZIP object code
    - Software: FOURCAST BioMediControl/SleepAnalyzer/SPControl/Auditor
  - Sensor/Transmitter: 5 KHz transmitter & chest strap—adjustable to any size
  - Receiver
    - Receiver: Polar 5 KHz smart receiver
    - Power supply & dc voltage level amplifier for data receiver
      - CMOS line driver: DS14C88
      - Capacitor: 68 $\mu$F rated for 16 Volts
      - Capacitor: 22 $\mu$F rated for 16 Volts
      - Resistor: 270 Ω
      - Resistor: 470 Ω
      - Three diodes: 1N4148
      - Printed circuit board: 1.75"×1.75"
    - Project enclosure: 4"×2"×1"
    - Female DB9 RS232 5 ft cable
- Long Range (1000 ft) Computer Powered Wire(less) Ultra Intelligent Real-Time Monitor
  - FOURCAST.ZIP object code
    - Software:FOURCAST BioMediControl/SleepAnalyzer/SPControl/Auditor
  - Sensor/Transmitter: 5 KHz transmitter, coded transmitter & chest strap—adjustable to any size
  - Repeater
    - Receiver: Polar 5 KHz smart receiver
    - Transmitter: 900 MHz band
    - 9 Volt rechargeable battery
    - LED switch: 0.512"×0.75"
      - Current limiting resistor: 2.2 kΩ
    - Project enclosure: 6"×2"×1"
    - Battery charger: 120 vac/9 vdc at 500 milliamps
      - Female plug for 9 vdc charger jack plug.
      - Voltage dropper: 270 Ω resistor
    - Three pole dip switch
  - Receiver
    - Receiver: 900 MHz band
    - Power supply & dc voltage level amplifier for data receiver
      - CMOS line driver: DS14C88
      - Capacitor: 68 $\mu$F rated for 16 Volts
      - Capacitor: 22 $\mu$F rated for 16 Volts
      - Resistor: 270 Ω

Resistor: 470 Ω
Three diodes: 1N4148
Printed circuit board: 1.75"×1.75"
Project enclosure: 4"×2"×1"
Female DB9 RS2325 ft cable
Three pole dip switch

DETAILED DESCRIPTION OF THE INVENTION

Automatic Data Acquisition and Hardware

FIG. 1 is a picture of a working prototype of a computer powered wire(less) ultra-intelligent real-time monitor. This monitor is comprised of a high speed electronic sensor/transmitter, a new battery operated repeater and battery charger, a receiver, and a new computer software program named FOURCAST SPControl/BioMediControl/SleepAnalyzer/Auditor (the main menu screen is shown). The object code (FOURCAST.ZIP) is included in this provisional patent application on a single 3.5" floppy disk. The sensor measures voltage pulses on the skin of a human being or animal. Any combination of separate clothing may be worn over the sensor/transmitter. Each pulse corresponds to a heartbeat. Various sensors can be used to measure different variables, including but not limited to biological heart rate, oxygen saturation, blood pressure, blood sugar, brain waves, temperature, industrial electrical voltage, electrical current, temperature, speed etc., and create analog data representing those variables. Such analog data are transmitted by existing and new hardwire or very low power 5 KHz wireless means to existing and new electronic analog to digital converters where they are converted to digital serial binary coded data. Such digital data are transmitted to an existing or new receiver, then to an existing or new computer where they are analyzed and charted.

FIG. 2 shows the schematic diagrams for a very low power short range transmission monitor (FIG. 2)-A, a very low power long range transmission monitor (FIG. 2)-B, and a power supply & dc voltage level amplifier for the data receiver (FIG. 2)-C. Digital data are transmitted by 5 KHz wireless (FIG. 2)-A or 900 MHz band wireless repeater (FIG. 2)-B means, to the receiver, then to the computer, at its serial port by means of an existing or new DB9 or DB25 plug or other plugs and adapters. The wireless receiver (5 KHz or 900 MHz) is powered from the serial port of the computer by a special electronic interfacing device (FIG. 2)-C, so that no batteries are required. The interfacing device rectifies the serial port pin voltages so as to provide a positive operating supply voltage to the receiver. It also amplifies the direct current (dc) signal from the receiver so that the voltage entering the serial port is correct and adequate to operate the serial port. Ordinarily, it is possible for all of the available serial port pin voltages to be negative, in which case no positive voltage can be obtained and the receiver cannot operate. The computer software program embodied in the invention, and described below, manipulates the voltages at DB9 plug pins 3, 4 & 7 or DB25 plug pins 2, 20 & 4 in an innovative way so as to cause a positive voltage to occur at one or more of the pins.

Data may also be entered into the computer directly via a computer keyboard. Data may also be imported from a data file created by another application, or copied from the screen of the computer or downloaded from another particular computer or from the internet.

Computer Software Program Data Storage and Display

The computer executes the software program under existing and new upwardly compatible versions of the operating systems: Windows 3.1, 95, 98, 2000, NT, XP or ME. The program reads the data, deciphers any associated security transmission codes, accepts only data with the same transmission code, separates, arranges and places the data into individual files, one for each variable. These files are then read, and the data in them analyzed. In that way if the files are updated by any of the means described above or by any other means whatsoever, the program will always analyze current data. The program analyzes the data by a new method named "moving window spectral antithetic time series analysis," which is described below in the sub section titled "mathematical operations."

FIGS. 3-A, 3-B, 3-C & 3-D illustrate that the program displays aggregate historical data (FIG. 3-A), as well as data split into uniquely new unbiased common cause effects and special cause effects (FIGS. 3-B, 3-C & 3-D). The aggregate data approach (FIG. 3-A) is comparable to the traditional method of standard statistical process control.

FIG. 3-B shows the splitting of biological vital signs data. The data are continuously updated regardless of the size of the pulse measurement. Breaches of the common cause chart (CCC) are attributed to systematic recurring internal biological common causes that are to be treated accordingly. Breaches of the special cause chart (SCC) are attributed to one of a kind external environmental special causes, that are to be removed if harmful. They may also be the effect of a one time application of a medication, the effect of which will eventually work itself into the common cause chart.

FIG. 3-C shows the splitting of industrial process measurement data. The data are continuously updated until there is a breach of either chart, and the process is stopped to prevent the production of defective items. Breaches of the common cause chart (CCC), are attributed to systematic recurring internal machine common causes, such as a worn part that is to be located and replaced. Breaches of the special cause chart (SCC), are attributed to one of a kind external environmental special causes, such as a batch of raw material.

FIG. 3-D shows the splitting of accounting cash flow data. The data are continuously updated regardless. The common cause chart (CCC) patterns are attributed to systematic changes such as those due to seasonality. Breaches of the special cause chart (SCC), are attributed to one of a kind expenditures, to be investigated so as to determine if they were authorized.

Computer Generated Charts

FIG. 4-A is a simple history chart of PULSE measured in beats per minute. The normal range for the category of person being monitored in this case is 55–95 beats per minute. The chart does not indicate any abnormal condition. Such a chart may be selected and produced by the new computer program in this invention, except that it would contain more data, such as that appearing on the more advanced common cause and special cause charts, described next.

FIGS. 4-B, 4-C, 4-D & 4-E illustrate how the data in FIG. 4-A are spilt into common cause variations and special cause variations, and displayed on the computer screen. Two sets of dual common cause variations and special cause variations charts are displayed. One set is displayed in terms of the original units of the data and the other set is displayed in terms of standard deviations from the mean of the original data. The methodology for creating the dual common cause variations and special cause variations charts is an innovation that is central and unique to the invention. Also, the invention gains its practical utility from the new information that is conveyed by the new unbiased dual common cause variations and special cause variations charts, the devices operated by the program, and the decisions made and the actions taken by the program and the user of the program. The common cause variations and the special cause variations data are also written to separate disk files where they can be read by other computer programs and used to manipulate and control other devices and processes. Such other computer programs may be activated independently or activated by the program embodied in the invention.

Each chart is labeled with the heading common cause variations or special cause variations as the case may be the name of the variable plotted on the chart the current time and date the time, date and number of the earliest and latest data points the time interval between plotted data points the value of the most recent data point the units of the data plotted on the chart user selected upper and lower control limits in terms of the original data and standard deviations the greatest percentage change in the data from the lowest value to the highest value or vice versa summary statistics including the Chi Squared statistic and test result for normality in the distribution of the data mean root mean square deviation minimum value maximum value control limits in units of original data and equivalent standard deviations control limits in units of standard deviations and equivalent in original data units number and percentage of breaches of the upper control limit number and percentage of breaches of the lower control limit Each breach is marked and numbered with the data point reference number. The charts contain 4 menu selections that permit selective and immediate spontaneous on the fly operations. 'Print' enables printing/faxing. 'Edit' enables copy/cut and past into another application like a word processor where a report can be produced and further edited and/or emailing to a remote location via a local area network or world wide via the internet. 'Customize' enables a custom multiple chart arrangement sub menu as follows: cascade (partially overlaping), full screen (one chart at a time rotating between charts) and layout (all charts on one screen). 'Transformations' enables mathematical transformations.

FIG. 4-B shows chart breaches—83 & 167 of the 55 beats per minute lower control limit. This indicates that with random effects removed, a systematic condition exists which is abnormal for the category in which the person being monitored belongs.

FIG. 4-C shows a chart breach—167 of the 3 standard deviation lower control limit. This indicates that with random effects removed, a systematic condition exists which is abnormal for the individual being monitored.

Complete List of the Program Menus

The following main and sub menus are used to direct various program operations that facilitate the main functions of the program that are describe above. Additional sub and sub-sub menus can be viewed by clicking on the main selection with the mouse. The immediately relevant menu selections [customize, communications (monitor) and stop] and the preferred mode of operation are described further, below, in the section titled "OPERATION."

Main menu: File. Edit. File Operations. Data Conversion/Importation. Communications (monitor). Calculate. Report. Customize. Help. Readme. Stop. Start Keyborad macro. Reset/Close/Record. Save Keyboard macro.

Sub menus:

File: Create input data. Open/Import (list/update input data). Run description. Specify variables. Plot variables [Graphics(looking for trends). Detailed (for data checking). Histogram (data distribution)]. Print all output windows displayed. Look at (edit) any file/directory. Erase a file. Exit.

Edit: Cut. Copy. Paste.

File Operations: Transformations [M moving average. Cumulative (inv. of D). Differencing (inv. of C). Aggregate]. Multiply the contents of two files. Add the contents of two files. Subtract one file from another. Divide one file into another. Take reciprocals of a file. Exponentiate a file. Divide by time. Divide by square root of time. Take natural logs of a file. Take logs (base 10) of a file. Take inverse natural logs of a file. Take inverse logs (base 10) of a file. Multiply a file by a constant. Divide a file by a constant. Add a constant to a file.

Data Conversion/Importation: MSDOS prompt. Convert non-standard file to FOURCAST.

Communications (monitor): Automatic logon. Edit automatic logon file. Monitor [select a chart code (0,1,2,3,4,5,6). Select an option (C-create. S-resume. R-restore)]. Create/edit small communications file.

Calculate: Model parameters.

Report: Model parameters. Plot special cause chart (residuals). Plot common cause chart (fitted values). Histogram of residuals. Histogram of fitted values. Review current output text.

Customize: FOURCAST. SPControl. BioMediControl. SleepAnalyzer. Auditor. As before in last session. Font style and color. Background color. Save for next session. Personalized legend.

Help: What is FOURCAST SPControl/BioMediControl/SleepAnalyzer/Auditor? View on screen. Demonstration macros. Creating input data. Updating input data. Output. Printing. About FOURCAST SPControl/BioMediControl/SleepAnalyzer/Auditor. Shareware registration.

Readme:

Stop. Do you want to print all charts? Yes. No. Do you wish to terminate monitor? Yes. No.

Start Keyborad macro: Preset teaching demonstration macros. User recorded macros.

Reset/Close/Record: Start/restart keyboard macro recording. Customize record/playback options. Clear/close all windows.

Save Keyboard macro: End user recording of a macro and save it.

Operation

Before the user can use the computer powered wire(less) ultra-intelligent real-time monitor, user supplied computer equipment and related utility software must be installed as follows. Install a computer. Install a mouse if menu selections are to be made by using the mouse. Install a printer and standard 8.5"×11" paper if the printing features of the program are to be used. Install a modem and make arrangements for internet email services and telephone services, and install the related software if the Fax/Email and Telephone-Caller ID alarm features of the program are to be used. Plug the modem into a telephone wall receptacle. Turn on the computer and start the windows operating system. Install the software program winzip. The computer, mouse, printer, paper, modem, internet services, telephone wall receptacle, windows, and winzip are commonly, readily and easily available items, provided separately by the user. If winzip is unavailable an unzipped arrangement of the program files is available on floppy disk.

For Short Range Operation Install the Short Range Receiver as Follows

Select the short range 5 KHz receiver. Insert the DB9 plug (or other appropriate plug and/or connector) into the serial port of the computer. Place the receiver box at least one foot away from the computer or any other device that might interfere with its operation. The operating range of the transmitter and receiver is the responsibility of the manufacturer and not this invention. As per the recommendation of the manufacturer of the transmitter and receiver, place the receiver within 3 feet of the transmitter. The maximum distance of 3 feet assumes optimal orientation and electromagnetic environmental conditions. Therefore, under many actual circumstances, a shorter distance will be necessary to insure proper operation.

The application being described in this example is one in which the user is relatively stationary, such as when they are lying down and/or sleeping. In this case, the preferred location of the receiver is directly below the chest area, under the mattress, and centered between the sides of the bed on which the user is lying. Then, the user can roll on the bed and still remain within the operating range.

If the monitor is being used in a nursery or other multiple client facility, security is of paramount importance. Therefore, the beds or other monitoring stations should be well in excess of 3 feet apart. Furthermore, only coded transmitters should be used.

For Long Range Operation Install the Long Range Receiver as Follows

Select the long range 900 MHz band receiver. Insert the DB9 plug (or other appropriate plug and/or connector) into the serial port of the computer. Place the receiver box at least one foot away from the computer or any other device that might interfere with its operation. Select one of the available channels by setting the 3 pole dip switch on the repeater box and make the identical selection on the receiver box. Plug the battery charger into a 120V receptacle, and into the charging jack of the repeater. Use the lighted LED switch on the repeater to turn it on. The LED glows in the on position. The operating range of the transmitter and receiver is the responsibility of the manufacturer and not this invention. As per the recommendation of the manufacturer of the transmitter and receiver, place the repeater within 3 feet of the transmitter. The maximum distance of 3 feet assumes optimal orientation and electromagnetic environmental conditions. Therefore, under many actual circumstances, a shorter distance will be necessary to insure proper operation. If the battery is charged, then the charger may be unplugged from the repeater. The user of the sensor/transmitter and the repeater, moving together may travel away from the receiver, but, as per the recommendation of the manufacturer of the transmitter and receiver, no farther than 1000 feet. The maximum distance of 1000 feet is based on an assumption that optional external antennae are installed on the repeater and the receiver, and optimal orientation and electromagnetic environmental conditions. Therefore, under many actual circumstances, a shorter distance will be necessary to insure proper operation. The repeater and receiver are provided with internal loop antennae for which the specified operating distance is a maximum of 400 feet. This maximum distance of 400 feet is based on an assumption that the provided internal loop antennae is installed in the repeater and the receiver, and optimal orientation and electromagnetic environmental conditions. Therefore, under many actual circumstances, a shorter distance will be necessary to insure proper operation.

The application being described in this example is one in which the user of the sensor/transmitter seeks mobility in and around a house. As an example, consider a square, one level, 5000 square foot house. The maximum distance that could be required is only 100 feet. If the house is built on two levels, the maximum distance required is only 50 feet. Such a house is very large and well above average in size. Therefore, the normal range of 400 feet is expected to meet and exceed most if not all such needs. If the user chooses to travel outside the house, then the actual range is limited to whatever the prevailing conditions will bear. If the battery in the repeater discharges, the user and the repeater must return together to the location of the charger, where the charger must be plugged into the charging jack of the repeater.

The application being described in this example is one in which at certain times, the user is relatively stationary, such as when they are lying down and/or sleeping. In this case, the preferred location of the repeater is directly below the chest area, under the mattress, and centered between the sides of the bed on which the user is lying. Then, the user can roll on the bed and still remain within the operating range. The battery inside the repeater may discharge during the period when the user is asleep. Therefore, the preferred location of the charger is near the bed in which the user lies down to sleep, and plugged into the repeater. When the user awakes and is ready to travel away from the bed, the charger is unplugged from the repeater. The user can then travel with the repeater as described above.

Installing the Computer Program

The program is installed as follows:

1. Execute winzip to expand (unzip) FOURCAST.ZIP into its component parts, including the object codes FOURCAST.EXE, SETUP.EXE, and other related files, object codes, and a run time module.
2. Execute the program SETUP.EXE to install FOURCAST.EXE.
3. Execute the program FOURCAST.EXE to obtain the initial screen (FIG. 1) and operating menus.

Computer Program Customization

In addition to the unique methodological innovation of moving window spectral antithetic time series analysis and the dual common cause variations and special cause variations charts, the program calculates and creates new and unique practical decision making diagnostic support information. It also features a sophisticated and progressive alarm system that maximizes the state of the art in wireless and computer technology, including sound, color, print/fax/email, and a telephone-caller ID alarm. To help explain these features and their importance, consider first the options available to the user. Some of these options are related to the computational methodology which is described below in the sub section titled "mathematical operations."

Click on the main menu item CUSTOMIZE, and customize the program features by making the following menu selections:

a) The type of monitor, based on the monitoring activity to be performed. The choices are FOURCAST where the specific data type are unknown, SPControl for monitoring industrial data, BioMediControl for monitoring biological data, SleepAnalyzer for monitoring sleep data and Auditor for monitoring accounting and financial data. For example, if the type of monitor selected is BioMediControl, the options are as follows.

b) Names and/or labels that appear as a legend on all charts and text associated with the chart data.

c) The electronic sensor/transmitter used to measure the variables that are to be monitored.

d) An industry or human population group classification and its associated upper and lower values within which normal conditions are considered to exist. The default classifications for the human population include but are not limited to the following. For oxygen saturation, 94% to 100% for all human beings, where % mean percent.

For heart rate
in newborn infants, 70–170 bpm
infants 1 year old, 80–160 bpm
1–2 years old, 80–130 bpm
2–4 years old, 80–120 bpm
4–6 years old, 75–115 bpm
6–10 years old, 70–110 bpm
males 10–12 years old, 65–105 bpm
females 10–12 years old, 70–110 bpm
males 12–14 years old, 60–100 bpm
females 12–14 years old, 65–105 bpm
males 14–16 years old, 55–95 bpm
females 14–16 years old, 60–100 bpm
males 16 years and older, 50–90 bpm
females 16 years and older, 55–95 bpm where bpm means beats per minute. The upper and lower values of each group may be edited separately within the program by opening the file in which the above selection is stored. The program gives instructions for doing that.

e) Yes, to turn on the automatic Print/Fax/Email alarm, otherwise No.

f) The maximum number of standard deviations within which normal conditions are considered to exist.

g) The criterion for activating the automatic alarm. Selection "t" sets the criterion to the length of time for which an abnormal condition exists. Selection "n" sets the criterion to the number of times that consecutive data values fall outside the range specified for normal conditions.

h) If the time criterion "t" is selected, the threshold time for which an abnormal condition must exist before the print/fax/email and telephone caller-ID alarm are initiated. If the number criterion "n" is selected, the number of consecutive times that the range specified for normal conditions is exceeded before the print/fax/email and telephone caller-ID alarm are initiated.

i) The viewing time, from 1 to 10 seconds per chart, between when the charts are to be updated. Data are collected as they occur, possibly at shorter intervals, and held in memory for periodic updating of the charts.

j) The time length, in minutes, of historical data to be displayed on each chart, limited only by the ability of the computer to store data. The default sampling interval of 1 may be increased. Upon request, observations are grouped and averaged as necessary so as to span the history that is requested. It may be necessary to display more data than actually requested so as to make each group equal in size.

k) The shortest window length, longest window length, and increment to select the optimal multivariate moving window spectral antithetic time series model that will analyze the data and split it into common cause effects and special cause effects for display on the dual common cause variations and special cause variations charts.

l) The differencing and antithetic times series analysis options for selecting the optimal multivariate moving window spectral antithetic time series model.

m) The communications protocol used for reading data from the automatic measuring sensors that collect data to be monitored. These include the identification number of the serial communications port, the communicating speed or baud rate in bits per second, the data byte size in bits per byte, and the number of start and stop bits. The telephone number that the computer will dial, the email message, and the communications protocol, in case the telephone-caller ID alarm is initiated.

n) The names of the variables to be monitored. In the case of certain measuring sensors, the names are automatically supplied by the program, in accordance with the type of sensor. For example, in the case for a heart rate sensor, the name defaults to PULSEbpm. In the case of a pulse oximeter, the names default to SPO2% and PULSEbpm. The names may be edited.

o) A run description that describes the nature of the monitoring activity, and appears as a legend on all charts and text associated with the chart data.

p) The program automatically supplies a run description. For example if BioMediControl was selected, the run description will default to "FOURCAST BioMediControl." The run description may be edited.

Starting the Monitor

Select the main menu item COMMUNICATIONS (MONITOR). Select the type or types of charts to be plotted from:

0—History only
1—History & standard deviations
2—Special cause
3—Common cause
4—History & special cause
5—History & common cause
6—Special cause & common cause where selection 2 through 6 include standard deviations.

Select one of the following:

c—to create new charts. Data from the last session will be copied to a backup file.

s—to resume updating of already existing charts from the last session.

r—to restore the charts from the backup files, and resume updating of the restored charts.

Before installing the sensor, check the connection between the receiver and the computer as follows. Start the monitor and select "c" to create a new chart. After a about 5 seconds, with no signal from the transmitter, a "O" followed by the time and date should appear at the top left hand corner of the data display area of the screen.

Installing the Sensor

Place the wireless Sensor/Transmitter and chest strap pictured in FIG. 1 around the chest of the human body so that the plastic part is at the front on the chest and the strap is at the back of the chest. Adjust the strap for a firm but comfortable fit. Use water to moisten the part of the plastic that is in contact with the skin of the user. The Sensor/Transmitter will automatically sense a voltage pulse each time the heart beats, and transmit a signal to the 5 KHz receiver.

Continuous Updating of the Charts

Consider for example, selection "c" to create new charts and chart selection "6" to plot special cause & common cause charts. The program automatically opens the serial port of the computer, reads the data at the port and creates the charts (FIGS. 4-B, 4-C, 4-D & 4-E). The program continuously reads the sensor data arriving at the serial port and updates the charts. A new plot is made at each update. The values updated are:

- the current time and date
- the time, date and number of the earliest and latest data points
- the time interval between plotted data points
- the value of the most recent data point
- the units of the data plotted on the chart
- the user selected upper and lower control limits in terms of the original data
- the user selected upper and lower control limits in terms of standard deviations from the mean
- the greatest percentage change in the data, from the lowest value to the highest value or vice versa
- summary statistics including
- the Chi Squared statistic and test result for normality in the distribution of the data
- mean
- root mean square deviation
- minimum value
- maximum value
- control limits in units of original data and equivalent standard deviations
- control limits in units of standard deviations and equivalent in original data units
- number and percentage of breaches of the upper control limit
- number and percentage of breaches of the lower control limit Each breach is marked and numbered with the data point reference number.

Progressive Alarm Systems

Under normal conditions, defined as data points falling between the upper and lower control limits, the color of the charts is white. If at any time a data point falls above the upper control limit or below the lower control limit, an abnormal condition exists, and there is an alarm as follows. A single breach of the control limits results in a sound alarm and a blue screen, and the beaching point is marked with the number of the observation for reference. If the condition returns to normal, the sound stops and the screen returns to white. Two consecutive breaches will sound the alarm and turn the screen yellow for caution. Three breaches will sound the alarm and turn the screen red to signal danger. The home user and/or an attending observer such as a friend or family member is alerted to give assistance. By adding external speakers, a mother can hear the computer sound alarm from anywhere in the house, and respond to her baby. In an institution, a professional caregiver is alerted to investigate a biological condition. Once again if the condition returns to normal, by itself or due to intervention, the sound alarm stops and the screen returns to white. If the screen remains red for a period of time longer than the period specified in the computer program customization menu item h above, the program will continue the sound and color graphics alarms. However, it will also initiate the Print/Fax/Email alarm, dial and send a telephone alert, and a caller ID to the telephone number specified in the computer program customization menu item m above. This permits a professional caregiver to read the charts from anywhere in the world. Through existing local area networking methods, a computer located at a central station can display the screen of any one of several bedside computers where the program is running and charting the data.

If the data transmission code changes and therefore cannot be verified, the data are ignored. If verifiable data ceases to arrive at the serial port due to a disconnect or an out of range transmitter, the sound alarm, red color alarm and telephone caller-ID alarm are initiated. A screen message "NO SIGNAL" will appear. Changing the antennae circuit so as to limit the transmission range will limit the radius within which the user may travel before the alarm is activated.

Stopping the Monitor

The monitor is stopped by clicking on the stop icon, then selecting YES to print all charts or NO otherwise, then selecting YES to terminate the monitor.

Mathematical Operations: Moving Window Spectral Antithetic (MWSA) Time Series Model The MWSA algorithm is a particular method of time series analysis. It may be viewed as performing a decomposition of a stationary time series into component cycles. It is based on modeling in the frequency domain. It is assumed that the time series is comprised of a family of several hidden cyclical components as depicted in FIG. 5. While it may be relatively easy to observe a simple trend, it becomes increasingly difficult to sort out and assess the interaction of several component cycles as the number of cycles increases. A mathematical model can assist in representing the component cycles, and in measuring the way in which the cycles may be changing, both in amplitude and phase, over time.

Consider the continuous process variable measured by the sensor/transmitter at discrete time intervals, represented as the time series y(t), t=1, 2, . . . , n. The time series is assumed to contain trend, constant frequency periodic (cyclical), and random components. In order to estimate the correlation structure of y(t), a moving window of length T<n is defined in the time domain. The moving window is used to generate sequences of data points in the time domain: y(1) to y(T), y(2) to y(T+1) , . . . , y(n−T+1) to y(n). Each pair of adjacent windows in the sequence contains an observation on the input and output process for each frequency in the frequency domain. This creates multiple observations for obtaining least squares estimates of the parameters that describe the behavior of the component cycles over time. The time series is assumed to contain a fundamental cycle of period T as well as other shorter cycles having frequencies that are multiples of the fundamental frequency. The window length T is chosen to obtain the best fit (minimum means square error) of a Tth order discrete autoregressive time domain model given by:

$$y(t) = \sum_{k=1}^{T} y(t-k)b(k) + \varepsilon(t), \quad t = T+1, T+2, T+3, \ldots, \infty$$

where b(k)=parameter, coefficient of y lagged k time periods, $$\sum_{k=1}^{T} b(k) < \infty, \quad \forall T,$$

$\epsilon(t)$=an unobservable error term, sequence of IID normally distributed random variables with mean zero and variance $\sigma^2$.

Model Estimation

A Fourier transform is used to estimate the spectral density function for each window y(m−1+t), m=1, 2, . . . , n−T+1, from $$Y_m(\omega) = \sum_{t=1}^{T} y(m-1+t)\exp(-i\omega t), \quad m = 1, 2, \ldots, n-T+1,$$

$$-\pi < \omega < \pi$$

where m is the window number, and the index of the realization of a cycle at frequency ω, and $i=\sqrt{-1}$.

The frequency domain model is specified as follows $$Y_m(\omega)=Y_{m-1}(\omega)B(\omega)+V_m(\omega),\ m=2, 3, \ldots, n-T+1,\ -\pi<\omega<\pi$$

where $V_m(\omega)$ is the corresponding error term.

Assuming that the time series is stationary, then the random component cycles (random amplitude and phase) will be statistically independent (orthogonal). Then, the estimation of B(ω) can be conducted on a frequency by frequency basis. The least squares estimators of B(ω) are found from $$\hat{B}(\omega) = \sum_{m=2}^{n-T-1} Y'_{m-1}Y_m(\omega) / \sum_{m=2}^{n-T-1} |Y_{m-1}(\omega)|^2, \quad -\pi < \omega < \pi,$$

where ' denotes the complex conjugate.

Model Fitting

Since the window length is T, the first fitted time period is T+1. Denoting the fitted values of y(t) by ŷ(t) and Y(ω) by Ŷ(ω), the fitted values in the frequency domain are obtained from $$\hat{Y}_{m+1}(\omega)=Y_m(\omega)\hat{B}(\omega),\ m=1, 2, \ldots, n-T+1,\ -\pi<\omega<\pi,$$

which are inverse transformed to obtain the time domain fitted values $$\hat{y}(m+T-k) = (1/T)\sum_{\omega=-\pi}^{\pi} Y_m(\omega)\exp(i\omega k),$$

$$m = 2, 3, \ldots, n-T+1, \quad k = 1, 2, \ldots, T.$$

Rewrite these fitted values as follows $$\hat{y}(t),\ t=T+1, T+2, T+3, \ldots, n$$

Next, the antithetic time series process is applied to ŷ(t), removing any bias that it may contain, as follows $$\hat{y}_c(t)=w\hat{y}(t)+(1-w)\hat{y}'(t),\ t=T+1, T+2, T+3, \ldots, n$$

where $$\hat{y}'(t) = \bar{y} + \left(1 - k\sqrt{n-t+1}\right) r_{ZZ^p}(s_z/s_{z^p})\{\hat{z}_t^p - z^p\},$$

$$t = T+1, T+2, T+3, \ldots, n,$$

where z(t)=y(t)+λ, the exponent of the power transformation is set to p=−0.001, and w, k and a location shifting constant λ are determined so as to minimize the mean square of the fitted error ŷ(t)−y(t), where $y_t$ are observed values, and s and r represent standard deviation and correlation coefficient respectively. These new unbiased fitted values $\hat{y}_c(t)$ are plotted on the new common cause variations chart.

Finally, the new special cause variations chart of residuals are obtained from $$\hat{\epsilon}(t)=\hat{y}_c(t)-y(t),\ t=T+1, T+2, T+3, \ldots, n.$$

The major differences between the frequency domain MWSA method and time domain methods is that MWSA values are unbiased, and the way in which cycles are represented. In this MWSA frequency domain method, representation of cycles is automatic as they appear in the spectrum. Each cycle is allowed to vary in amplitude and phase. In time domain methods, cycles are modeled by backward shift operators, and each cycle is restricted to a constant amplitude and phase. Even so, specifying them is extremely tedious, even when only a small fraction of the full spectrum of cycles is to be represented.

Conclusion, Ramifications, and Scope

Accordingly, the reader will see that the computer powered wire(less) ultra-intelligent real-time monitor of this invention can be used to monitor any data that can be measured by an electronic sensor. It is a full featured, universal and versatile cost-effective device that can be used by anyone in a home;

in a medical establishment;

in a manufacturing plant;

in a laboratory;

or by an auditor.

As a tool for professional use

It will provide early rather than late warning of abnormalities and impending failure;

it will greatly assist quality control engineers in reducing manufacturing cost and raising productivity;

it will help an auditor detect irregularities that might otherwise go unnoticed;

it will raise the quality and lower the cost of health care;

it will focus technician, nurse and physician time and effort on critical conditions and what led up to them;

it is an instrument that will greatly assist medical professionals in saving lives and making people well.

Although the description of the invention contains many specifications, these should not be construed as limiting the scope of the invention but as merely providing illustrations of some of the presently preferred embodiments of this invention. For example, biological vital sign data in a medical environment can be replaced by speed of a machine or temperature of a chemical bath in a manufacturing environment, or any appropriate data for any other environment in which monitoring is to be performed.

Thus the scope of the invention should be determined by the appended claims and their legal equivalents, rather than by the examples given.

What is claimed is:

1. A universal mobile telemonitoring device to monitor the interactions between a plurality of variables and generate a plurality of local alarms and a plurality of world wide alarms when said interactions become abnormal, comprising:

a) a sensor/transmitter with self-contained means for continuously collecting data and self-contained very low power very low frequency wireless means for continuously transmitting said data;

b) a repeater with self-contained means for continuously receiving said data from said very low power very low frequency wireless means for continuously transmitting, and self-contained low power plurality of high frequency wireless means for continuously transmitting said data;

c) a short range receiver with self-contained means for continuously receiving said data from said very low power very low frequency wireless means for continuously transmitting, and hard wire means for continuously transmitting said data;

d) a long range receiver with self-contained means for continuously receiving said data from said low power plurality of high frequency wireless means for continuously transmitting, and said hard wire means for continuously transmitting said data and;

e) a computer program to operate a computer to power either of said receivers to receive said data from said hard wire means for continuously transmitting, decompose said data into separate time charts of common cause effects and special cause effects for each of said plurality of variables, and to initiate a graduated progressive sound, screen color, printer and worldwide email, fax machine, and telephone alarm sequence whenever any value on said time charts falls outside of user specified upper and lower limits;

whereby a user of said telemonitoring device may connect said sensor/transmitter to a source of said data, for continuous transmission of said data in a dry or wet environment for at least 2500 hours, for a transmission distance of at least 3 feet, extendable by use of said repeater by up to at least 1000 feet, place said computer at a remote location within the range of said transmission distance, observe said alarm sequence, and so be alerted to take action regarding said source and receive said time charts anywhere in the world where a telecommunications service is available.

2. The universal mobile telemonitoring device in claim 1 wherein:

said telephone further comprises means for caller identification;

said telephone further comprises means for receiving email messages;

said computer further comprises a color graphics display monitor;

said computer further comprises a receiving port;

said computer further comprises a modem;

said computer further comprises a sound speaker and;

said computer further comprises a printer.

3. The universal mobile telemonitoring device in claim 1 wherein:

said sensor/transmitter has said self-contained means for continuously collecting said data on a plurality of variables;

said sensor/transmitter has self-contained means for uniquely coding said data for security and integrity;

said sensor/transmitter has self-contained hard wired means for continuously transmitting said data to said receiving port in said computer;

said sensor/transmitter has said self-contained very low power very low frequency wireless means for continuously transmitting said data, so as to minimize the weight and the cost of said sensor/transmitter, so as to minimize energy consumption, so as to limit the transmission range of said sensor/transmitter to about 3 feet thereby not interfering with other frequency sensitive equipment, and so as not to detune in the proximity of other objects and;

said sensor/transmitter has first means for continuously powering said self-contained means for continuously collecting and said self-contained very low power very low frequency wireless means for continuously transmitting for a distance of at least 3 feet for a period of at least 2500 hours.

4. The universal mobile telemonitoring device in claim 3 wherein:

said very low power very low frequency means for continuously transmitting is a 5 Khz band transmitter and;

said first means for continuously powering is a battery.

5. The universal mobile telemonitoring device in claim 1 wherein:

said repeater has said self-contained means for continuously receiving said data from said very low power very low frequency wireless means for continuously transmitting, said data being continuously collected by said self-contained means for continuously collecting in said sensor/transmitter;

said repeater has said self-contained low power plurality of high frequency wireless means for continuously transmitting said data, so as to extend the wireless transmission distance to at least 1000 feet and to insure that incoming said low frequency does not cancel with outgoing said high frequency and vise versa;

said repeater has means for switching from one high frequency to another high frequency to avoid interference from other sources of said one high frequency;

said repeater has second means for continuously powering said self-contained means for continuously receiving and said self-contained low power plurality of high frequency wireless means for continuously transmitting over a physical distance of at least 1000 feet for a time period of at least 48 hours before said second means for continuously powering requires recharging;

said repeater has means for recharging said second means for continuously powering while said repeater is in use;

said repeater has means for recharging said second means for continuously powering while said repeater is not in use and;

said repeater has means for turning said repeater on and off.

6. The universal mobile telemonitoring device in claim 5 wherein;

said means for continuously receiving said data from said very low power very low frequency means for continuously transmitting is a 5 Khz band receiver;

said low power plurality of high frequency wireless means for continuously transmitting is a radio frequency band transmitter;

said second means for continuously powering is a rechargeable battery and;

said means for recharging is a standard 110–120 volt to 6–9 volt electrical outlet wall transformer.

7. The universal mobile telemonitoring device in claim 1 wherein:

said short range receiver has said self-contained means for continuously receiving said data from said very low power very low frequency wireless means for continuously transmitting, said data being continuously collected by said self-contained means for continuously collecting in said sensor/transmitter;

said short range receiver has self-contained said hard wired means for continuously transmitting said data to said receiving port in said computer and;

said short range receiver has means for using voltages obtained from connections at said receiving port in said computer to power said self-contained means for continuously receiving said data from said very low power very low frequency wireless means for continuously transmitting, and said hard wired means for continuously transmitting, so as to eliminate the need for batteries in said short range receiver.

8. The universal mobile telemonitoring device in claim 7 wherein:

said means for continuously receiving said data from said very low power very low frequency means for continuously transmitting is said 5 Khz band receiver.

9. The universal mobile telemonitoring device in claim 1 wherein:

said long range receiver has said self-contained means for continuously receiving said data from said low power plurality of high frequency wireless means for continuously transmitting, said data being continuously collected by said self-contained means for continuously collecting in said sensor/transmitter;

said long range receiver has means for switching from one high frequency to another high frequency to avoid interference from other sources of said one high frequency;

said long range receiver has self-contained said hard wired means for continuously transmitting said data to said receiving port in said computer;

said long range receiver has means for using voltages obtained from connections at said receiving port in said computer to power said self-contained means for continuously receiving said data from said low power high frequency wireless means for continuously transmitting, and said hard wired means for continuously transmitting, so as to eliminate the need for batteries in said long range receiver and;

said long range receiver has means for turning said long range receiver on and off.

10. The universal mobile telemonitoring device in claim 9 wherein:

said means for continuously receiving said data from said low power plurality of high frequency wireless means for continuously transmitting is a radio frequency band receiver.

11. The universal mobile telemonitoring device in claim 1 wherein:

said computer program has processing means to automatically calibrate to user specified upper and lower limits selected from a menu of group norms generated by said computer program, in terms of units and in terms of standard deviations;

said computer program has processing means to accept independent user specified upper and lower limits;

said computer program has processing means to continuously read said data from said receiving port in said computer, said data being continuously collected by said self-contained means for continuously collecting in said sensor/transmitter;

said computer program has processing means to filter extraneous transmissions that enter said receiving port in said computer;

said computer program has processing means to create a permanent history file of said data and corresponding date and time, and store said date and time, and said data in said permanent history file in said computer so that said date and time, and said data can be accessed and retrieved by other computer software applications;

said computer program has processing means to continuously update and extend said permanent history file of said date and time, and said data;

said computer program has processing means to continuously retrieve said date and time, and said data from said permanent history file;

said computer program has processing means to continuously separate historical said data on said plurality of variables into individual variables;

said computer program has processing means to transform said individual variables into transformed individual variables according to one of a plurality of mathematical formulae;

said computer program has processing means to continuously create individual time charts of said transformed individual variables on said display monitor in terms of the units of said transformed individual variables;

said computer program has processing means to continuously create individual time charts of said transformed individual variables on said display monitor in terms of standard deviations;

said computer program has processing means to decompose said transformed individual variables into said common cause effects and said special cause effects;

said computer program has processing means to continuously create individual time charts of said common cause effects on said display monitor in terms of the units of said transformed individual variables;

said computer program has processing means to continuously create individual time charts of said common cause effects on said display monitor in terms of standard deviations;

said computer program has processing means to continuously create individual time charts of said special cause effects on said display monitor in terms of the units of said transformed individual variables;

said computer program has processing means to continuously create individual time charts of said special cause effects on said display monitor in terms of standard deviations;

said computer program has processing means to increase the time span of said individual time charts so as to include more history on said transformed individual variables;

said computer program has processing means to decrease the time span of said individual time charts so as to include less history on said transformed individual variables;

said computer program has processing means to continuously compute summary statistics for said transformed individual variables and display said summary statistics on said individual time charts;

said computer program has processing means for continuously sounding an audible alarm if the most recent value of said transformed individual variables falls outside of user specified upper and lower limits;

said computer program has processing means for making a permanent visible mark on said individual time charts at all points where any value of said transformed individual variables falls outside of user specified upper and lower limits;

said computer program has processing means for continuously changing the screen color of said display monitor to white if the most recent value of said transformed individual variables falls inside of user specified upper and lower limits;

said computer program has processing means for continuously changing the screen color of said display monitor to blue if the most recent value of said transformed individual variables falls outside of user specified upper and lower limits;

said computer program has processing means for continuously changing the screen color of said display monitor to yellow if the most recent two values of said transformed individual variables fall outside of user specified upper and lower limits;

said computer program has processing means for continuously changing the screen color of said display monitor to red if the most recent three values of said transformed individual variables fall outside of user specified upper and lower limits;

said computer program has processing means for sending said individual time charts to said printer, emailing said individual time charts to a user specified recipient, faxing said individual time charts to said fax machine, and continuously telephoning and sending a user specified email message to said telephone via a user specified telephone number if the screen color of said display monitor remains red for a user specified time period;

said computer program has processing means for continuously changing the screen color of said display monitor to red if no data is received at said receiving port in said computer for a first predetermined time period;

said computer program has processing means for continuously telephoning and sending a user specified email message to said telephone via a user specified telephone number if no data is received at said receiving port in said computer for a second predetermined time period and;

said computer program has processing means for copying said individual time charts into other computer software applications.

12. A method for the universal mobile telemonitoring of the interactions between a plurality of variables and generating a plurality of local alarms and a plurality of world wide alarms when said interactions become abnormal, comprising the steps of:

a) connecting a sensor/transmitter with self-contained means for continuously collecting data and self-contained very low power very low frequency wireless means for continuously transmitting said data, to a source of said data, collecting said data and transmitting said data in a dry or wet environment for at least 2500 hours for a transmission distance of at least 3 feet;

b) using a repeater with self-contained means for continuously receiving said data from said very low power very low frequency wireless means for continuously transmitting, and self-contained low power plurality of high frequency wireless means for continuously transmitting said data, to receive said data and to transmit said data for an additional transmission distance of at least 1000 feet;

c) using a short range receiver with self-contained means for continuously receiving said data from said very low power very low frequency wireless means for continuously transmitting, and hard wire means for continuously transmitting said data, to receive said data and to transmit said data to a computer;

d) using a long range receiver with self-contained means for continuously receiving said data from said low power plurality of high frequency wireless means for continuously transmitting, and said hard wire means for continuously transmitting said data, to receive said data and to transmit said data to said computer and;

e) using a computer program to operate said computer at a remote location within the range of said transmission distance, to power either of said receivers to receive said data from said hard wire means for continuously transmitting, to decompose said data into separate time charts of common cause effects and special cause effects for each of said plurality of variables, and to initiate a graduated progressive sound, screen color, printer and worldwide email, fax machine, and telephone alarm sequence whenever any value on said time charts falls outside of user specified upper and lower limits, thereby alerting an observer to take action regarding said source and to receive said time charts anywhere in the world where a telecommunications service is available.

13. The method of universal mobile telemonitoring according to claim 12, comprising steps of:

enabling the caller identification function in said telephone;

enabling the email message function in said telephone;

enabling the color graphics display monitor function in said computer;

enabling the receiving port function in said computer;

enabling the modem function in said computer;

enabling the speaker function in said computer and;

enabling the printer function in said computer.

14. The method of universal mobile telemonitoring according to claim 12, comprising steps of:

using said sensor/transmitter to continuously collect said data on a plurality of variables;

using said sensor/transmitter to uniquely code said data for security and integrity;

using said sensor/transmitter to continuously transmit said data by very low power very low frequency wireless means, so as to minimize the weight and the cost of said sensor/transmitter, so as to minimize energy consumption, so as to limit the transmission range of said sensor/transmitter to about 3 feet thereby not interfering with other frequency sensitive equipment, and so as not to detune in the proximity of other objects and;

using a miniature battery to continuously power said sensor/transmitter and very low power very low frequency wireless means for continuously transmitting for a distance of at least 3 feet for a period of at least 2500 hours.

15. The method of universal mobile telemonitoring according to claim 12, comprising steps of:

using said repeater to continuously receiving said data from said very low power very low frequency wireless means for continuously transmitting, said data being continuously collected by said self-contained means for continuously collecting in said sensor/transmitter;

using said repeater to continuously transmit said data by low power plurality of high frequency wireless means, so as to extend the wireless transmission distance to at least 1000 feet and to insure that incoming said low frequency does not cancel with outgoing said high frequency and vise versa;

operating said repeater so as to switch from one high frequency to another high frequency to avoid interference from other sources of said one high frequency;

powering said repeater by rechargeable battery to operate continuously for a time period of at least 48 hours before said rechargeable battery requires recharging;

using a standard 110–120 volt to 6–9 volt electrical outlet wall transformer to operate and recharge said rechargeable battery in said repeater if said repeater is in use and;

using a standard 110–120 volt to 6–9 volt electrical outlet wall transformer to recharge said rechargeable battery in said repeater if said repeater is not in use;

turning said repeater on when said repeater is in use and turning said repeater receiver off when said repeater is not in use.

16. The method of universal mobile telemonitoring according to claim 15, comprising steps of:

continuously receiving said very low power very low frequency transmission at about 5 Khz and;

continuously transmitting said low power plurality of high frequency in the radio frequency band.

17. The method of universal mobile telemonitoring according to claim 12, comprising steps of:

using said short range receiver to continuously receive said data from said very low power very low frequency wireless means for continuously transmitting, said data being continuously collected by said self-contained means for continuously collecting in said sensor/transmitter;

using said short range receiver to continuously transmit said data by hard wire means to said receiving port in said computer and;

powering said short range receiver with voltages obtained from connections at said receiving port in said computer, so as to eliminate the need for batteries in said short range receiver.

18. The method of universal mobile telemonitoring according to claim 12, comprising steps of:

using said long range receiver to continuously receive said data from said low power plurality of high frequency wireless means for continuously transmitting, said data being continuously collected by said self-contained means for continuously collecting in said sensor/transmitter;

operating said long range receiver so as to switch from one high frequency to another high frequency to avoid interference from other sources of said one high frequency;

using said long range receiver to continuously transmit said data by hard wire means to said receiving port in said computer;

powering said long range receiver with voltages obtained from connections at said receiving port in said computer, so as to eliminate the need for batteries in said long range receiver and;

turning said long range receiver on when said long range receiver is in use and turning said long range receiver off when said long range receiver is not in use.

19. The method of universal mobile telemonitoring according to claim 12, comprising steps of:

using said computer program to automatically calibrate to user specified upper and lower limits selected from a menu of group norms generated by said computer program, in terms of units and in terms of standard deviations;

using said computer program to accept independent user specified upper and lower limits;

using said computer program to continuously read said data from said receiving port in said computer, said data being continuously collected by said self-contained means for continuously collecting in said sensor/transmitter;

using said computer program to filter extraneous transmissions that enter said receiving port in said computer;

using said computer program to create a permanent history file of said data and corresponding date and time, and to store said date and time, and said data in said permanent history file in said computer so that said date and time, and said data can be accessed and retrieved by other computer software applications;

using said computer program to continuously update and extend said permanent history file of said date and time, and said data;

using said computer program to continuously retrieve said date and time, and said data from said permanent history file;

using said computer program to continuously separate historical said data on said plurality of variables into individual variables;

using said computer program to transform said individual variables into transformed individual variables according to one of a plurality of mathematical formulae;

using said computer to continuously create individual time charts of said transformed individual variables on said display monitor in terms of the units of said transformed individual variables;

using said computer program to continuously create individual time charts of said transformed individual variables on said display monitor in terms of standard deviations;

using said computer program to decompose said transformed individual variables into said common cause effects and said special cause effects;

using said computer program to continuously create individual time charts of said common cause effects on said display monitor in terms of the units of said transformed individual variables;

using said computer program to continuously create individual time charts of said common cause effects on said display monitor in terms of standard deviations;

using said computer program to continuously create individual time charts of said special cause effects on said display monitor in terms of the units of said transformed individual variables;

using said computer program to continuously create individual time charts of said special cause effects on said display monitor in terms of standard deviations;

using said computer program to increase the time span of said individual time charts so as to include more history on said transformed individual variables;

using said computer program to decrease the time span of said individual time charts so as to include less history on said transformed individual variables;

using said computer program to continuously compute summary statistics for said transformed individual variables and to display said summary statistics on said individual time charts;

using said computer program to continuously sound an audible alarm if the most recent value of said transformed individual variables falls outside of user specified upper and lower limits;

using said computer program to make a permanent visible mark on said individual time charts at all points where any value of said transformed individual variables falls outside of user specified upper and lower limits;

using said computer program to continuously change the screen color of said display monitor to white if the most recent value of said transformed individual variables falls inside of user specified upper and lower limits;

using said computer program to continuously change the screen color of said display monitor to blue if the most recent value of said transformed individual variables falls outside of user specified upper and lower limits;

using said computer program to continuously change the screen color of said display monitor to yellow if the most recent two values of said transformed individual variables fall outside of user specified upper and lower limits;

using said computer program to continuously change the screen color of said display monitor to red if the most recent three values of said transformed individual variables fall outside of user specified upper and lower limits;

using said computer program to send said individual time charts to said printer, email said individual time charts to a user specified recipient, fax said individual time charts to said fax machine, and continuously telephone and send a user specified email message to said telephone via a user specified telephone number if the screen color of said display monitor remains red for a user specified time period;

using said computer program to continuously change the screen color of said display monitor to red if no data is received at said receiving port in said computer for a first predetermined time period;

using said computer program to continuously telephone and send a user specified email message to said telephone via a user specified telephone number if no data is received at said receiving port in said computer for a second predetermined time period and;

using said computer program to copy said individual time charts into other computer software applications.

20. A method for the universal mobile telemonitoring of the interactions between a plurality of variables and generating a plurality of local alarms and a plurality of world wide alarms when said interactions become abnormal, comprising the steps of:

a) connecting a sensor/transmitter with self-contained means for continuously collecting data and self-contained hard wire means for continuously transmitting said data, to a source of said data, collecting said data and transmitting said data to the receiving port of a computer;

b) using a computer program to operate said computer to power said sensor/transmitter with voltages obtained from connections at said receiving port, to receive said data from said hard wire means for continuously transmitting, to decompose said data into separate time charts of common cause effects and special cause effects for each of said plurality of variables, and to initiate a graduated progressive sound, screen color, printer and worldwide email, fax machine, and telephone alarm sequence whenever any value on said time charts falls outside of user specified upper and lower limits, thereby alerting an observer to take action regarding said source and to receive said time charts anywhere in the world where a telecommunications service is available.

* * * * *